US008678109B2

(12) United States Patent
Orban et al.

(10) Patent No.: US 8,678,109 B2
(45) Date of Patent: Mar. 25, 2014

(54) INTELLIGENT CONTROLLED PROCESS FOR WELL LATERAL CORING

(75) Inventors: Jacques Orban, Provo, UT (US); Claude Joseph Vercaemer, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 420 days.

(21) Appl. No.: 13/124,444

(22) PCT Filed: Oct. 31, 2008

(86) PCT No.: PCT/RU2008/000678

§ 371 (c)(1), (2), (4) Date: Jun. 8, 2011

(87) PCT Pub. No.: WO2010/050840

PCT Pub. Date: May 6, 2010

(65) Prior Publication Data

US 2011/0247881 A1 Oct. 13, 2011

(51) Int. Cl.
*E21B 49/02* (2006.01)

(52) U.S. Cl.
USPC ..... 175/244; 175/61

(58) Field of Classification Search
USPC ..... 175/45, 61, 94, 104, 40, 107, 244
See application file for complete search history.

(56) References Cited

U.S. PATENT DOCUMENTS

| | | | | |
|---|---|---|---|---|
| 2,148,373 | A * | 2/1939 | Garfield | 175/247 |
| 2,382,933 | A * | 8/1945 | Zublin | 175/61 |
| 2,594,292 | A * | 4/1952 | Cornelius | 175/78 |
| 2,708,103 | A * | 5/1955 | Williams, Jr. | 175/246 |
| 3,517,756 | A * | 6/1970 | Goss | 175/4 |
| 4,354,558 | A * | 10/1982 | Jageler et al. | 175/45 |
| 4,463,814 | A * | 8/1984 | Horstmeyer et al. | 175/45 |
| 4,714,119 | A | 12/1987 | Hebert et al. | |
| 5,667,025 | A | 9/1997 | Haessly et al. | |
| 5,887,655 | A * | 3/1999 | Haugen et al. | 166/298 |
| 5,954,131 | A | 9/1999 | Sallwasser | |

(Continued)

FOREIGN PATENT DOCUMENTS

| | | |
|---|---|---|
| EP | 1780372 | 12/2009 |
| RU | 2180388 | 3/2002 |

(Continued)

OTHER PUBLICATIONS

Office action for the equivalent Russian patent application No. 11121814 issued on Jul. 11, 2012.

*Primary Examiner* — Daniel P Stephenson
(74) *Attorney, Agent, or Firm* — Chadwick A. Sullivan; Brigitte Echols

(57) ABSTRACT

A system for coring an underground formation surrounding a borehole, comprising: a tool body that can be positioned in the borehole near the formation to be cored, the tool body including a motor; a rotary drive head connected to the motor; a rotary tool connected to the rotary drive head and one end and carrying a drill bit at the other end; a drive mechanism including an operable anchor for anchoring in the borehole and an axial drive for advancing tool body and the rotary tool; and a guide for urging the rotary tool laterally from the borehole into the surrounding formation; wherein the rotary tool is a tubular coring tool conveying an annular drill bit.

20 Claims, 25 Drawing Sheets

(56) References Cited

U.S. PATENT DOCUMENTS

| | | | | |
|---|---|---|---|---|
| 6,712,158 | B2 * | 3/2004 | Moore | 175/20 |
| 2003/0034177 | A1 * | 2/2003 | Chitwood et al. | 175/61 |
| 2006/0054354 | A1 * | 3/2006 | Orban | 175/40 |
| 2006/0081398 | A1 * | 4/2006 | Arian et al. | 175/58 |
| 2007/0215349 | A1 | 9/2007 | Reid et al. | |
| 2011/0247881 | A1 * | 10/2011 | Orban et al. | 175/244 |

FOREIGN PATENT DOCUMENTS

| | | |
|---|---|---|
| SU | 732519 | 5/1980 |
| SU | 1617137 | 12/1990 |
| WO | 91/19075 | 12/1991 |
| WO | 2004/072437 | 8/2004 |
| WO | 2007/027683 | 3/2007 |

* cited by examiner

INTELLIGENT CONTROLLED PROCESS FOR WELL LATERAL CORING

TECHNICAL FIELD

This invention relates to extracting formation cores from the side of a previously drilled well. In particular the invention relates to an integrated coring apparatus to carry out this process and the downhole analysis of the core obtained.

BACKGROUND ART

Formation coring is required for the detailed study and analysis of a vertical section of reservoir or other rock layers. To retrieve the core as intact as possible, it is cut from the rock by an annular core bit. The central column of rock passes through the centre of the coring bit and, as the bit cuts deeper, is received by a hollow cylindrical Core Barrel above the coring bit, where it is protected by a series of rubber baffles. When the bit has cut deep enough to fill the core barrel, it is withdrawn from the hole and the core is removed for study. By doing this the actual sequence of rock strata can be readily identified.

To as greatest extent as possible, core samples are taken in an undamaged, physically unaltered state. The formation material may be solid rock, friable rock, conglomerates, unconsolidated sands, coal shales, gumbos, or clays.

A typical coring tool in use today can be seen in WO 2007/027683. In this coring tool only relatively small core samples can be obtained and also only one core can be acquired before having to retrieve the tool to the surface for analysis.

Other examples of coring tools can be found in US 2007/0215349, U.S. Pat. Nos. 4,714,119 and 5,667,025.

DISCLOSURE OF THE INVENTION

This invention provides a system for coring an underground formation surrounding a borehole, comprising:

- a tool body that can be positioned in the borehole near the formation to be cored, the tool body including a motor;
- a rotary drive head connected to the motor;
- a rotary tool connected to the rotary drive head and one end and carrying a drill bit at the other end;
- a drive mechanism including an operable anchor for anchoring in the borehole and an axial drive for advancing tool body and the rotary tool; and
- a guide for urging the rotary tool laterally from the borehole into the surrounding formation;

wherein the rotary tool is a tubular coring tool conveying an annular drill bit.

The rotary drive head is preferably operable to allow the axis of the coring tool to deviate from the axis of the tool body, and can include an adjustable connection to allow the deviation of the coring tool axis to be varied.

The tool can also include means to direct the deviated axis in a predetermined direction.

In one embodiment, the rotary drive head has a female connector to which the coring tool connects, and a hollow shaft extending away from the rotary drive head into the tool body. In this case, the motor can connect to the outer surface of the hollow shaft to drive the rotary drive head. The system may also further comprise an angular position sensor for detecting the angular position of the hollow shaft, which preferably derives the rotary speed of the hollow shaft.

The anchor typically comprises at least one set of radially-extending pads which engage the borehole wall when activated to anchor the tool body in the borehole. The axial drive can operate to act against the anchoring force provided by the pads when activated. In one example, the drive mechanism comprises a hydraulic system, the pads and the axial drive comprising pistons in cylinders to which hydraulic fluid is provided. The drive system typically comprises at least two sets of pads which can be alternately activated to allow the tool body to move in either direction along the borehole.

It is particularly preferred that the coring tool comprises an outer rotary tube carrying the annular drill bit, and connected to the rotary drive head; and an inner core barrel for supporting a core drilled from the formation by the coring tool. The inner core barrel normally does not rotate with the outer rotary tube,. and can be connected to a shaft which extends through the rotary drive head.

An orientation reference collar surrounding the shaft can be provided, the collar and shaft being provided with inter-engaging formations to prevent relative rotation. The inter-engaging formations can comprise a key and groove which allow the collar to slide relative to the shaft. The collar is preferably moveable between a first position in which it is held against rotation relative to the tool body, and a second position in which it is held against rotation relative to the outer rotary tube; such that in the first position, the collar and shaft can rotate with the tool body relative to the outer rotary tube, and in the second position can rotate with the outer rotary tube relative to the tool body. An electromagnet can be provided that is operable to move the collar between the first and second positions. In one embodiment, the collar has an inclined surface, and a corresponding inclined contact surface is provided on the tool body; such that when the collar is in the first position the effect of contact between the inclined surfaces is to orient the shaft to a predetermined angular position relative to the tool body.

The collar and outer rotary tube can also be provided with inter-engaging formations (such as a tooth and recess) to prevent relative rotation.

A pinching system is preferably provided at the end of the inner core barrel near to the drill bit on the outer rotary tube, the pinching system being operable to apply a controlled movement to the inner core barrel to break a drilled core from the formation. In one embodiment, the pinching system comprises one or more axial cuts in the end of the core barrel, and inter-engaging sloped surfaces on the inner surface of the outer rotary tube and on the outer surface of the inner core barrel, engagement of the sloped surfaces being effected by relative axial movement of the outer rotary tube and the inner core barrel and the cuts allowing reduction in the diameter of the end of the inner core barrel.

The tool body may further comprise a pump for pumping well fluid around the drill bit. In some design, Where the coring tool comprises an outer rotary tube carrying the annular drill bit, and an inner core barrel for supporting a core drilled from the formation, the pump operating to pump fluid down the outside of the rotary tube to the drill bit so as to return up an annular space between the outer rotary tube and the inner core barrel. A cuttings processing device can be located near an outlet of the pump for processing cuttings retuning from the drill bit.

The guide typically comprises a guide surface that is inclined relative to the axis of the borehole, and a guide anchor that is operable to lock the guide in place. The surface may inclined 3-20° relative to the borehole axis, typically at about 6°.

The anchor can comprise at least one pad that can be urged against the borehole wall to lock the guide in place. The pad can also act to push the guide against the borehole wall to lock it in place. In one embodiment, the anchor is operated by a hydraulic system including a pump and reservoir in the tool body, connected to the guide by a hose. In another, the anchor is operated by rotation of a nut which moves wedges which act on the pads to move them radially relative to the guide. The nut can be rotated by means of the coring tool, formations being provided on the coring tool which can engage in corresponding formation on the nut to allow rotation of the coring tool to rotate the nut.

The guide can be connected to the tool body by a telescopic attachment, or by means of a bar slidably mounted in latches on the tool body, the latches being operable to lock the bar to the tool body to hold the guide at a predetermined distance from the tool body.

A position sensor can be provided to measure separation of the guide from the tool body, for example a sensor that detects the position of marks on the telescopic attachment or sliding bar.

The system preferably comprises an orienting system for directing the guide surface in a predetermined direction. The orienting system can act to turn the tool body so that the guide surface faces the predetermined direction.

A navigation system can also be provided for determining the position and orientation of the tool body, typically comprising magnetometers for determining position relative to the earth's magnetic field, and/or inclinometers for determining position relative to the earth's gravitational field. The system may further comprise means to determine any offset between the position of the guide and the navigation system.

Where the orienting system comprises a collar on the guide through which the coring tool projects, the coring tool can be provided with formation which can engage with corresponding formations on the collar so that rotation of the coring tool acts to turn the guide to the predetermined direction.

One or more core protectors that can be introduced into the coring tool to protect the bottom of a core obtained from the formation. Where multiple cores are obtained in a single coring tool, a core protector can be positioned between each separate core. A preferred form of separator comprises a chamfered end region to facilitate introduction into the coring tool, centralisers to hold it centrally in the coring tool, and at least one seal to contact the inner surface of the coring tool. In one embodiment, the protector and coring tool further comprise inter-engaging formations (such as radially extendible catches and a groove into which the catches can project) such that the protector can be held securely in place in the coring tool.

A pressure control system can be connected to the interior of the coring tool and operable to maintain the pressure inside the coring tool at a predetermined level irrespective of the ambient pressure around the coring tool.

Preferably, the guide further comprises a storage receptacle for protectors to be introduced into the coring tool. In this case, the guide can comprise an operable trap, the coring tool being engagable with an operating mechanism of the trap so as to open the trap to make the protectors available to the coring tool, and to close the trap to allow the coring tool to enter the formation.

A transmission shaft can be used to connect the rotary drive head to the coring tool. The transmission shaft can be flexible compared to the coring tool, and typically has substantially the same length as the coring tool. One or more stabilisers can be mounted on the transmission shaft. The guide will typically have a contact surface that is substantially the same length as the coring tool.

In another embodiment, the coring tool comprises alternating rigid and flexible sections. In this case, the flexible sections can be normally permanently bent.

Sensors can be provided for measuring mechanical parameters (such as weight on bit, torque and/or rate of penetration) of the drilling process during coring.

Sensors can also be provided for measuring parameters of drilled cuttings obtained during the coring process, such as cutting size which may be determined by ultrasonic, density and/or filtering measurements.

Further sensors can be provided for measuring a parameter of a core obtained using the coring tool. The sensor is typically located in the guide. The sensor can comprise a gamma ray detector. further comprising a gamma ray source. The gamma ray sensor and gamma ray source can be positioned on opposite sides of the core so that a line connecting the sensor and source does not pass though the centre of the core. The sensor and source can arranged to operate as the core is rotated. First and second gamma ray sensors can be located at a different positions in the guide. Alternatively, the system can comprising a system for moving the core laterally to a second position in which it is rotated while the sensor and source operate. The measured core parameter can be used in a tomography process.

Further sensors can be provided for measuring the diameter of a core inside the coring tool, for example an ultrasonic mechanical or electrical sensor.

Other sensors can be provided for measuring the thermal characteristics of a core inside the coring tool and the system can further comprise a heater for applying heat to the core.

In another embodiment, the system comprises sensors for sensing the force required to shear a core from the formation using the coring tool. The coring tool can shear the core by applying a torque to the core, the sensor measuring the torque to determine the shear force. Another sensor can be used to sense the maximum tensile value required to detach the core from the formation. In this case, the system can comprise means for gripping the core, and for applying tension until the core detaches from the formation.

The drill bit can comprise concentric rings of teeth.

The system can include means for plugging the hole from which a core is obtained. The plug can be arranged to seal against a casing surrounding the borehole. The system can further comprise means to eject the core from the coring tool.

Memory means can be provided for storing data related to the operation of the system. An electrical link can be provided to communicate data from the operation of the system to the surface of the borehole. This invention provides an integrated coring system which comprises a coring apparatus and an integrated logging system for downhole analysis of the core obtained from the coring apparatus.

The systems according to the invention have several features and advantages and allow various methods to be performed as will be apparent from the following summary.

Systems according to the invention allow extraction of long cores from the lateral side of an existing well, involving a single conveyance method. The core can be longer than the diameter of main well.

A integral coring system including a guide deflects the coring tool towards the wall of the well. The guide setting in the well-bore and the coring can be performed in one trip. The guide can be set, followed by the coring process and the guide unset. The can be repeated in one trip.

The tool-face of the guide can be chosen before the guide setting, the conveyance can be a tubing or drill-pipe or a coil tubing, and a down-hole extension mechanism can impose displacement during coring.

The invention provides an integral coring machine that can be operated via a wireline cable, and is capable to extract core at an inclination from the main well between 1 to 45 degrees.

A crawling system can be used to displace the machine is the well-bore, and the crawling machine can impose WOB for coring. The crawler Typically involves more than one set of pads.

The guide is supported by the coring machine. For example, the guide support is telescopic. The guide can be oriented by a rotary element of the coring machine. In one example, the rotary element is an orienting sub. Alternatively, the rotary element is the rotating coring assembly and head. The coring tool can be equipped with a key at its bottom which can engaged into a corresponding receptacle in the guide. The guide can be set by radial hydraulic system where a hydraulic hose transmits setting pressure from the coring machine to the guide.

In one embodiment, the guide can be kept at constant distance from the fixed pad of the crawler. Also, the distance can be measured between the guide and the coring machine or the depth of guide can be measured form the depth of the machine.

The coring tool is rotated by a down-hole motor such as an electrical motor.

A local down-hole circulation system can be provided by the machine and it is preferred that the local down-hole circulation can be reversed mode. A cuttings processing system can be installed near the circulation pump, for example a cutting cruncher can be the processing system. The processing system can also perform cutting size analysis.

The internal tube of the coring tool is preferably held in the correct place by the machine, but can be moved slightly upwards inside the coring tool. The core can be pinched at its tip under request. The internal tube of the coring tool can be locked onto the machine or onto the coring rotary system The tool-face of the internal tube is preferably imposed to a constant direction when locked onto the machine. Also, the tool face offset between the internal tube and the machine can be measured when locked onto the machine so that the tool-face of the internal tube of the coring tool can be known during coring.

The guide can be equipped a bore and a selection mechanism for coring tool displacement towards either the bore or the formation. Separating elements can be stored in the guide bore so that the coring tool can be plugged with a core separator. The separator is preferably equipped with seals and latches. Thus the flow channel from the machine to the coring tool can be positively isolated under request.

In one embodiment, the coring machine can bring the core to surface under pressure.

The coring tool is preferably kept parallel to the guide surface during coring. The tilt of the rotary head can be adjusted to insure the proper parallelism of the coring tool to guide surface. Also, a flexible transmission shaft (flex-joint) can be installed between the coring tool and the rotary head. Flex joint centralizers can be installed on the flexible transmission shaft.

In one example, the tool is made a succession of rigid and flexible sections. The rigid sections typically have a length similar to the guide surface. Where the cored hole is straight, the core in the rigid section of the coring tool can be undisturbed.

The flexible section of the internal tube can be made of a bellows, and the coring tool made as a succession of rigid and bend sections. The internal tube of the coring tool can be equipped with bent sections in one plane which impose bending to the external tube. In this case, the first rigid section imposes build-up angle for the cored hole. The first section is typically less than half the length of the other rigid section. A small near-bit under-gage stabilizer can be used and the cored hole can have constant curvature.

The coring tool can be a chain of straight segments, and the core is made of succession of mono-block, unperturbed cores, separated by spacers in the bend. The mono-block unperturbed core can be curved.

The coring tool can be kept straight in the main well-bore thanks to proper mechanical guidance of the coring machine.

Spacers can be installed between unperturbed core elements.

The coring machine supporting can support a logging system in the vicinity of the entrance of the cored hole for logging the core as it passes in front of this logging system. The logging system typically allows logging of natural gamma-ray emission of the core. Shielding can be installed in the vicinity of the gamma-ray detector to reduce the background noise measurement. The shield is typically made of heavy metal. The back-ground noise can be initially measured without presence of the core, so that this noise can be suppressed from the final measurement. One example allows gamma-gamma density measurement of the core. The measurement is performed by back-scattering effect when source and detector are at the same side of the core. Where the measurement is performed by ray transmission, source and detector are on opposite sides of the core. The measurement can be performed while the coring tool is rotated. The direct path between gamma-ray source and receiver is preferably not passing by the center of the core. The direct path for the gamma-rays can be two different cords through the core.

In another example, the core diameter is measured. The circumference of internal core barrel can be deformable and the change in circumference can be measured by the change of gap between the two tubes of the coring tool. A pulsed-echo ultrasonic transducer can be used to measure the difference of gap. In another case, the external tube is deformed by the internal tube, allowing direct detection via this external change.

One embodiment of the invention allows multiple short cores to be taken in the long coring tools. Also, at least some of the core elements stored in the core barrel can be ejected form the core barrel down-hole if they are not needed at surface. In one case, the ejected core(s) can be placed in the cored hole.

The core can be logged while it is retracted out of the cored hole, and when it is in the main borehole, preferably by passing the core in front of the logging system.

It is also preferred that the coring teeth are capable of cutting metal, cement and rock, allowing coring behind casing.

An integrated process comprising the invention involves the plugging of the cored hole in the side wall after it has been drilled. The cored hole can be plugged by ejection of a special plug in the cored hole; with a plug involving swellable material; with a plug involving mechanical expansion system; or using a hardenable or settable fluid. For example, cement slurry can be used to partially or totally fill the cored hole.

Special logging procedures can be used for special or deep information gathering. A special coring fluid can be placed at the appropriate interval in the main well before the coring process begins.

The down-hole electro-mechanic system can be controlled from surface via remote communication. Communication between the logging system to the coring machine is preferably performed via a cable. The logging tool may also store data in down-hole memory, in which case the system may operate using a battery.

The coring machine preferably provides down-hole measurements of coring torque; axial force (WOB) (in both directions). These allow determination of rock mechanic properties. The coring machine can also allow the core to be loaded with torque and/or axial force, and to measure the load (torque/axial load).

The coring system can also allow the detection of displacement (axial or rotation) of the core which can be used to obtain a direct measurement of rock mechanical properties. One example is to determine the Coulomb failure diagram.

The cutting teeth can be arranged to cut the core with a cylindrical step at the extremity to help in this determination. A pinching mechanism can be set to select to pinch on small or large diameters of the core tip. This can be used to determine the main compression stress perpendicular to the cored hole axis. The measurements can be performed for multiple cored hole drilled in different directions in a the same formation. At least six independent measurements can be taken, allowing determination of the principal stresses in the rock. Young's modulus can be obtained by buckling failure on a small diameter core, using axial loading on the core in the core barrel (based on Eulers' formula). Poisson's ratio can be obtained for core failure due to radial loading of the core between two opposite radial contacts when axial load is applied to the core.

A coring process according to the invention is preferably based on the rotation of the coring tool by a down-hole hydraulic motor such as a Moyno motor. Preferably, the motor and its transmission are hollow, in which case a full-bore valve can be installed in the motor by-pass hole. This allows a full-bore channel from the core barrel to the top of the down-hole motor. It is also preferred that the core can pass through the drilling motor and that the core can be fished by slick line through the tubing.

The system according to the invention can operate with deviation angle at the bottom of the well. The deviation angle for the cored hole can be set to zero, allowing an under-size core to be taken at the bottom of the main well or at full hole size.

Further aspects of the invention will be apparent from the following description.

BRIEF DESCRIPTION OF THE DRAWINGS

FIG. 12*a* shows a modified deviation guide with a storage hole for keeping the spacers in;

MODE(S) FOR CARRYING OUT THE INVENTION

Figure 1:
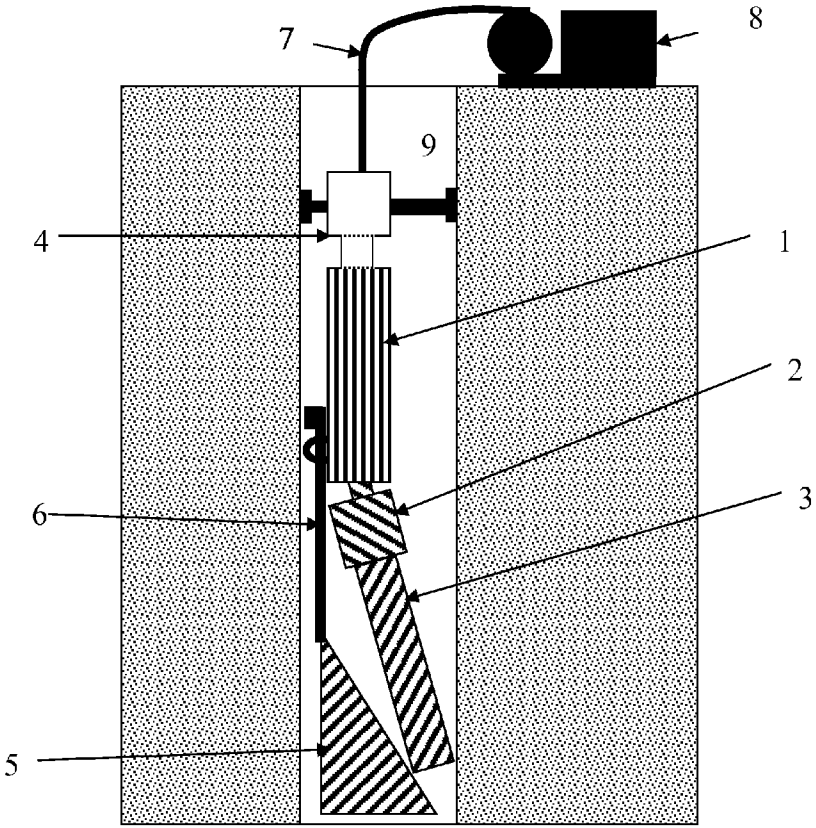
FIG. 1 shows a general view of the coring apparatus according to the invention.

FIG. 1 shows a general view of one embodiment of the invention. The coring apparatus 1 includes a lower rotary head 2 which supports the coring tool 3. The coring apparatus is also equipped with a means to generate axial force and displacement. This is preferably performed by the crawling system 4 of the coring tool. The core barrel can be pushed side-way into the formation by the deviation guide 5. This guide is supported by the coring machine via the support mechanism 6. In a first implementation, the coring system is installed in the well 9 via a wireline cable 7: this cable also feeds electrical power to the coring tool, as well as insuring telemetry between the tool and the surface unit 8.

Figure 2:
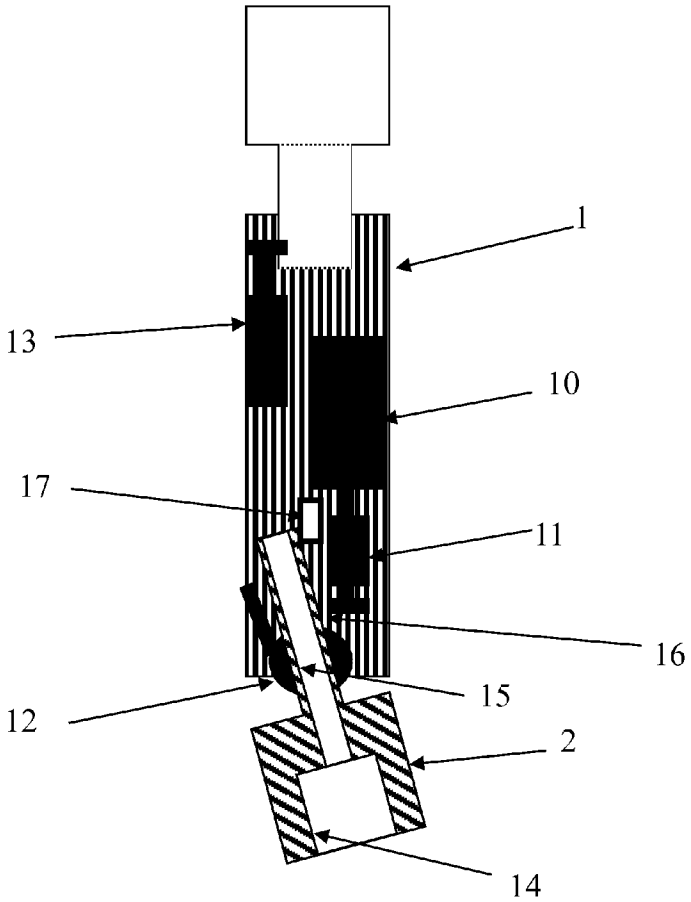
FIG. 2 shows the rotary head of the coring apparatus of FIG. 1.

FIG. 2 shows the rotary head in more detail. The lower rotary head 2 of the coring machine 1 is driven by a motor 10 and an optional gear box 11. The rotary head may be inclined versus the main coring tool axis thanks to a tilting system 12. It can also be a permanent bend sub, similar to the construction of steering motor used for directional drilling application. The azimuth of the plane containing the axes of the lower rotary head and the tool can also be imposed by a specific mechanism 13. This mechanism can orient the bend sub (which creates the axis inclination); another solution is to use a tilting system which can operate in all planes.

The internal torque transmission system is designed to be compatible with this variable inclination of the head. The rotary head is hollow and terminated by a female thread 14. It is extended by a hollow shaft 15. The drive motor is normally providing the rotary drive by connection to the outside surface 16 of this hollow shaft.

The angular position of the shaft is measured by the angular position sensor 17. This measurement has multiple benefits which will be explained later.

Figure 3:
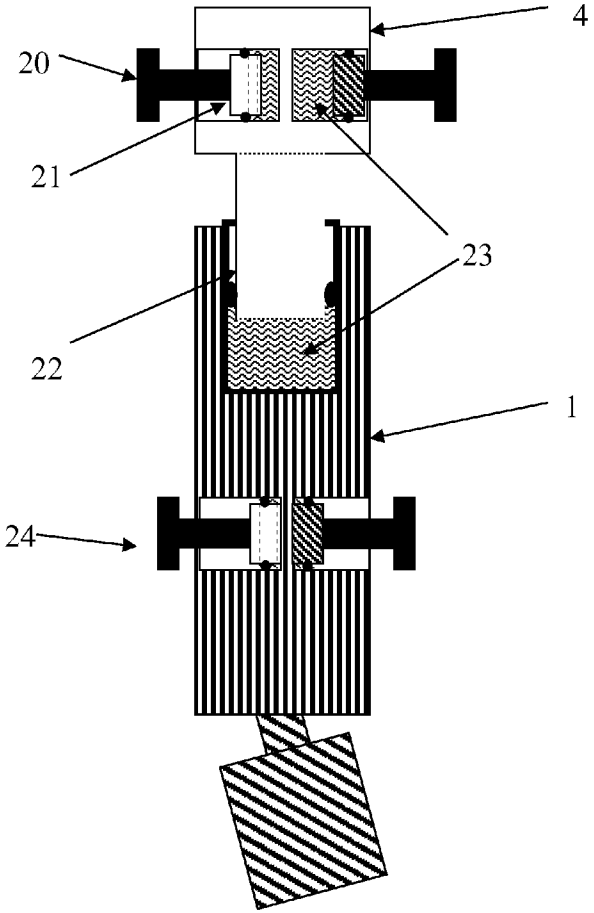
FIG. 3 shows an axial pushing system.

FIG. 3 shows an axial pushing system, or "crawler". The crawler 4 of the coring machine 1 consists at least of one set of pads 20 which can be pushed radially against the well bore, thanks to the radially extending system 21. These pads insure the clamping of the coring tool in the well-bore. The axial extension mechanism 22 allows a push/pull effect on the lower part of the coring tool, including the rotary head, the core barrel and the core. This push/pull effect generates the axial displacement of the coring tool in the well-bore. An hydraulic pressure system, involving hydraulic oil 23 can be used for such purpose. When the extension mechanism has reached full extension, the pads are retracted: the weight of the system is then supported either by the coring tool engaged in the formation around the core or by the wireline cable or by a mixture of the two. The extension mechanism is then contracted; the pads are re-opened against the well-bore and a new pushing extension can then start. The system is used in such a way to generate the required "weight-on-bit" during coring.

It should be noted that with such typical system, the forwards push for drilling is delivered by the crawling system, while the upwards movement can be achieved by pull on the wireline cable. However, the crawling system can assist the upwards pull of the core out of the out of the tight cored hole.

For efficient operation in highly inclined wells (or horizontal wells), a second set of pads 24 below the axial extension mechanism can be installed. With such a construction, the system can then move forwards and backwards with no dependence on gravity.

The double set of pads is also a good preventive method against stuck pads against the bore-hole. When one pad is stuck against the borehole due to any sticking effects, the other set of pad can be activated to keep the tool in the centre of the well and the stuck pad can then be pulled towards the centre of the well (or axial force can be also be applied by the crawler).

Figures 4A, 4B:
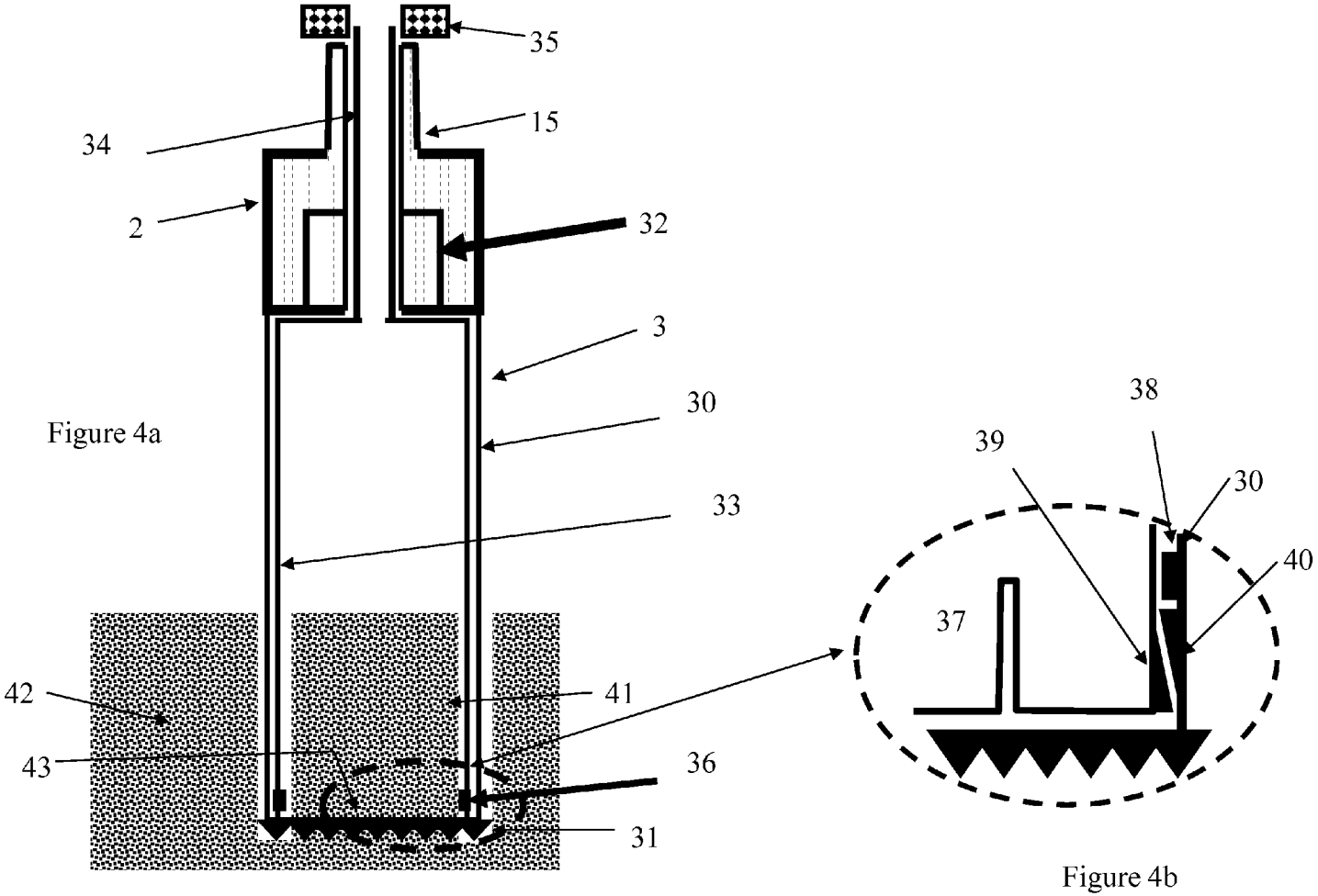
FIGS. 4*a* and 4*b* show a coring tool.

The coring tool is shown in FIGS. 4*a* and 4*b*. The coring tool 3 consists primarily of an external rotary tube 30 terminated by cutting teeth 31. This external rotary tube is rotated by the lower rotary head of the coring system as described above. The external rotary tube is typically terminated by a connection system 32 to the rotary head 2. Inside the external rotary tube, the internal core barrel 33 supports the core 41 when the coring tool enters into the formation 42. This internal barrel does normally not rotate. This internal static core barrel is made of a thin tube. The clearance between the external rotary tube and the internal static core barrel is quite small (typically in the range of millimeters).

In the normal design, this internal static barrel 33 allows the core to slide upwards into the coring tool 3. There is typically enough friction to keep the core engaged in the internal static tube. In the proposed solution, this internal static tube 33 is connected to a shaft 34 which extends inside the bore of the rotary head 2 and its hollow shaft 15. This extension shaft can be held static by a control mechanism 35 inside the coring apparatus 1. This feature allows the internal core barrel 33 to be held in a stationary position. In particular, the internal core barrel stays static even if rotary friction is generated on its external surface (for example direct friction due to small bending of the coring tool).

In some designs, this control mechanism can impose some movements onto the internal core barrel to detach the core from the formation and retain it in the barrel. This can be achieved thanks to a core pinching system 36 at the lower extremity of the coring tool. The application of a controlled movement to the internal core barrel allows the core to crack from the formation at the tip 43 of the core barrel. The control movement can be either a pulling effect on the core barrel or by rotating the barrel, which shears the core from the formation.

More detail of a core pinching mechanism is shown in FIG. 4*b*. The internal core barrel may be equipped with at least one axial cut 37 to allow some deformation of its average diameter. Normally this diameter can only be reduced, as rings 38 on the external tube prohibits radial growth. The internal core barrel 33 can be equipped with external conical surfaces 39, corresponding to a complimentary conical surface of the external tube 40. This core pinching system can be used to prevent the loss of the core in the well-bore as well as separate the core form the formation.

As general information, it is foreseen that the coring tool has a diameter in the range of 1.5 to 3". The coring tool is normally made of a number of elements of 30 ft. Its total length may reach up to 150 ft.

The coring tool may be constructed of sections of normal tool design separated by more flexible sections. The purpose and construction of such a coring tool will be described below.

Figure 5:
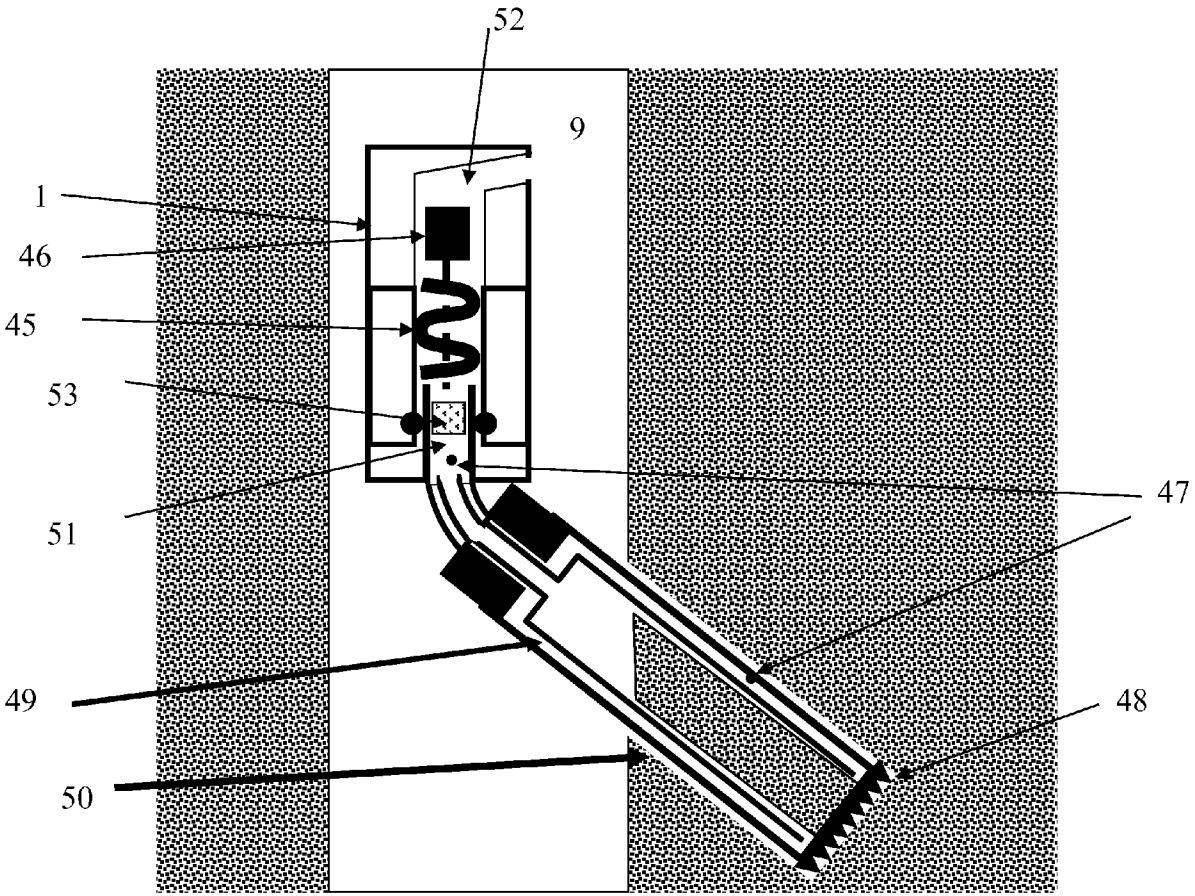
FIG. 5 shows a fluid circulation system.

FIG. 5 shows the fluid circulation system in the coring apparatus. The coring machine 1 includes a pump 45 driven by the motor 46: this motor is normally powered by electricity (as being inside a wireline tool) but other motor types could be used. This pump can be, but is not limited to, a Moyno-type pump. The pump circulates well fluid from the main well around the teeth of the coring tool. This fluid circulation insures the cooling of the core cutting teeth 21 at the leading edge of the coring tool. The fluid circulation also transports the cuttings 47 away from the cutting zone 48 into the main well bore.

In conventional fluid circulation practice, the fluid is pumped downwards to the cutting face in the small annulus 49 between the static internal tube and the external rotary tube; the fluid then return to the main well via the annulus 50 between the formation and the external rotary tube of the coring tool. However, in some applications, it is advantageous to use reverse circulation, compared to the previously described path. This can be achieved by reversing the rotation of the pump of the coring machine. In this case the cuttings reached the suction area 51 of the pump, pass through the pump and finally reached the discharge chamber 52 of the pump before being discharged into the main well 9.

For some applications, a cuttings processing system 53 can be installed either in the suction area 51 or discharge chamber 52.

The following processes for the cuttings processing system are proposed (but not limitative):

- Filtration of the larger cuttings so that they are not rejected in the main well.
- Cuttings size analysis, allowing characterization of the drilling process, as well as determination of rock properties. This will be described below.
- Crushing of the large cuttings to insure better cutting transport as well as lessening damage to the pump if installed in the suction area 51.

Figure 6:
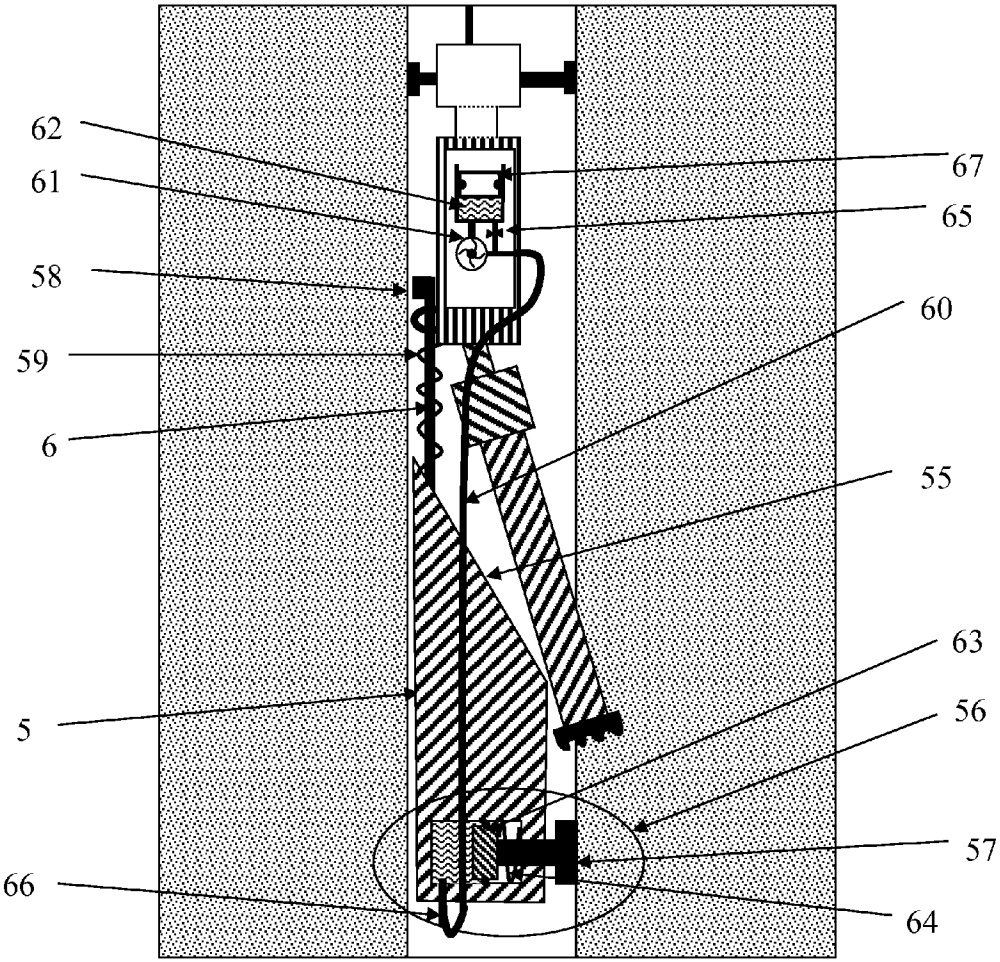
FIG. 6 shows a coring apparatus with a deviation guide.

FIG. 6 shows the deviation guide. It acts as a typical whipstock and insures side push of the coring tool towards the well-bore wall. It consists of an inclined surface 55 (inclined versus the well axis). This angle can be in the range from 3 to 20 degrees, with a preference for an angle in the range of 6 degrees. In an 8.5" well, the width of the inclination/deviation guide can be in the range of 6".

In FIG. 6, the guide is equipped with a mechanism 56 to allow it to be locked in a static position during the coring process. The preferred embodiment includes a pad 57 which pushes the guide to one side of the well-bore. In the preferred solution, the guide is pushed onto the opposite side of the well-bore to that which is being cored. With such a method, any side force created during the coring process reinforces the contact with the wall. This increases the capability to resist an axial sliding effect as friction is then increased.

The control mechanism to set/unset the radial pads of guide can be a hydraulic system. A hydraulic hose 60 is connected to the coring machine 1 and the guide. Oil is forced into this hose by a pump 61 from a reservoir 62: the reservoir is sealed by a volume compensating system such as a sealed sliding piston 67. The normal hydrostatic pressure is applied to the external surface of this volume compensating system, so that the whole hydraulic circuitry is acting above the hydrostatic pressure. This pumped oil pushes radial pistons 63 in the guide 5. A spring 64 retracts the pistons 63, when the valve 65 is open and the pump 61 is not activated. The hose makes a loop 66 below the pad: the loop length will change when the distance between the guide and the coring machine is altered.

The guide can be connected to the coring system via a telescopic system 6. This system is normally extended and tries to stay extended by itself, either due to gravity effect or "spring" effect 58. It has a limiting stop 59 for its stroke. The telescopic system insures a permanent link between the guide and the coring system at the same time as allowing multiple setting of the guide in the well-bore for multiple coring.

Figure 7A:
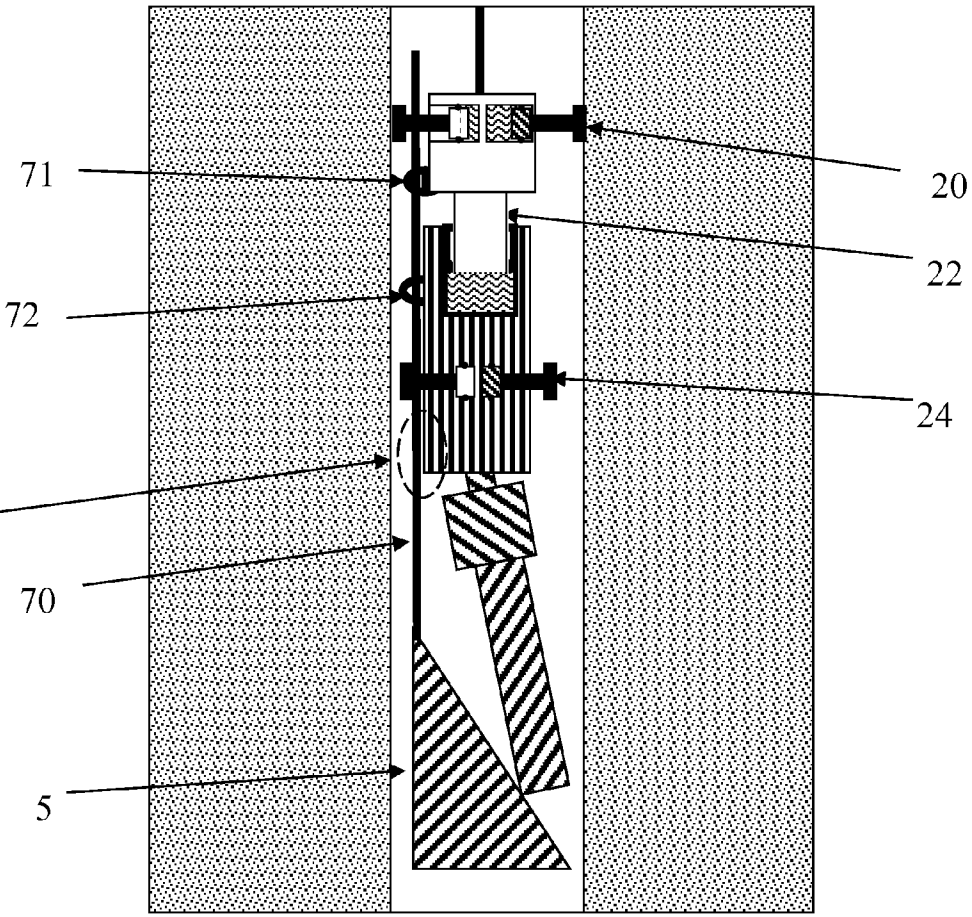
FIGS. 7*a* and 7*b* show an alternative construction to allow axial position control of the deviation guide.
Figure 7B:
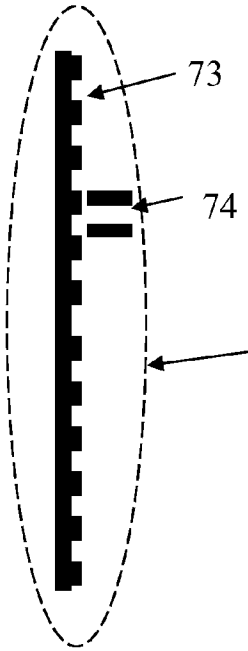

FIGS. 7*a* and 7*b* show an alternative construction to allow axial position control of the deviation guide. It is based on a modification of the telescopic mechanism. In this version, the guide 5 is supported by a set of continuous bars or tube 70 which extend above the crawler. These bars 70 can be locked onto the coring machine by the latches 71 and 72. Only one latch is acting at a given time. With proper coordination of latching and usage of the extension mechanism 22, it is possible to increase or decrease the distance between the coring tool and the guide. In particular, during coring, latch 71 is locked when the extension mechanism 22 is pushing the coring tool downwards, as a result the guide and the pads 20 are not moving. When the extension mechanism reaches full extension, the latches 71 and 72 are inverted, and the pads 20 and 24 opened. When the extension mechanism is then collapsed the guide will remain static in the well bore. A particular advantage of this method is that the load on pad 20 is reduced by the axial load of the guide.

Figure 8:
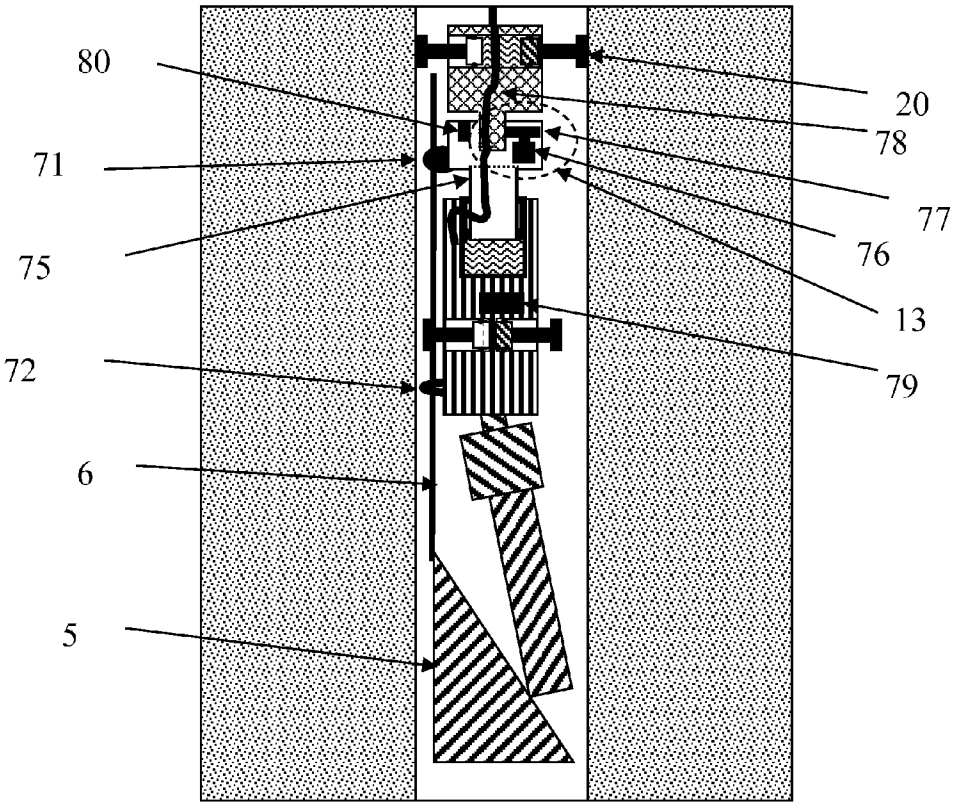
FIG. 8 shows an orienting sub to allow correct orientation of the deviation guide.

Before the setting of the deviation guide at a given depth, the guide must be orientated to the proper azimuth (or tool-face as it is commonly known in the industry) so that the core is taken from the desired formation. FIG. 8 shows one of the preferred designs for doing this. It can be achieved by the use of an orienting sub 75 placed below the upper set of crawling pads 20. This sub is driven in orientation by a system 13: this system consists of a motor 76 and optionally a gear system 77. Typically a bundle 78 of electrical wires and hydraulic hoses may be passing through the orienting sub, so this sub may be limited in one full turn to avoid twisting of the wires.

When the upper pads are pressed against the well-bore, rotation of the orientating sub is transmitted to the lower part of the coring machine. This rotation is also imposed on to the telescopic system 6 and the guide 5.

With such a construction, the orientation of the guide is determined directly by the "navigation" package 79 of the coring machine, it is therefore preferred that this navigation package is installed below the orientating sub. The navigation package can be composed of three magnetometers and three inclinometers, allowing the determination of either magnetic or gravitational parameters.

In some embodiments, the navigation package can be above the orienting sub; in which case, it is important to measure the angular offset of the orienting sub, for example, via an angle sensor 80.

This use of orienting sub can be combined with multiple type of guides and guide locking systems (in particular the proposed designs described above).

Figures 9A, 9B:
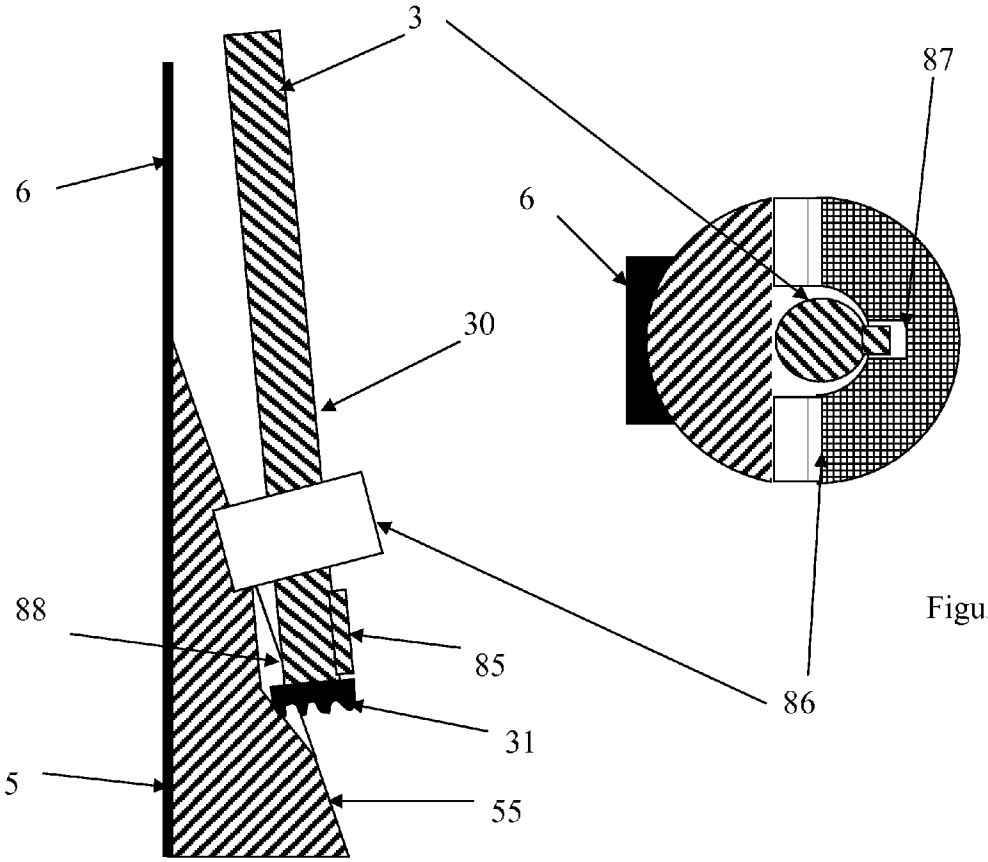
FIGS. 9*a* and 9*b* show an alternative design for orienting the guide tool-face.

FIGS. 9*a* and 9*b* show another design for orienting the guide which does not require an orienting sub. In this design the coring tool 3 itself is used as the rotating mechanism for the guide. The external tube 30 of the coring tool is equipped with an external key 85 on the bottom external surface just above the cutting teeth 31. This key can engage in a complimentary groove 87 in a crown 86 attached to the inclined surface 55 of the deviation guide. The engagement of the key in the groove is facilitated by the usage of large chamfer on the extremities of the key and groove.

This engagement is only possible when the telescopic system is fully extended. In this position, the tip of the coring tool is in the recess 88 of the guide 5. When the coring tool key is engaged in the grove of the guide crown, the guide turns with the rotary head until reaching the proper tool-face.

Figure 10B:
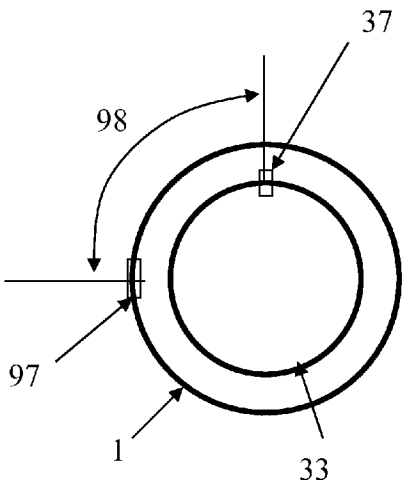
FIGS. 10*a* and 10*b* show a design to allow angular referencing of the core inside the core barrel.
Figure 10A:
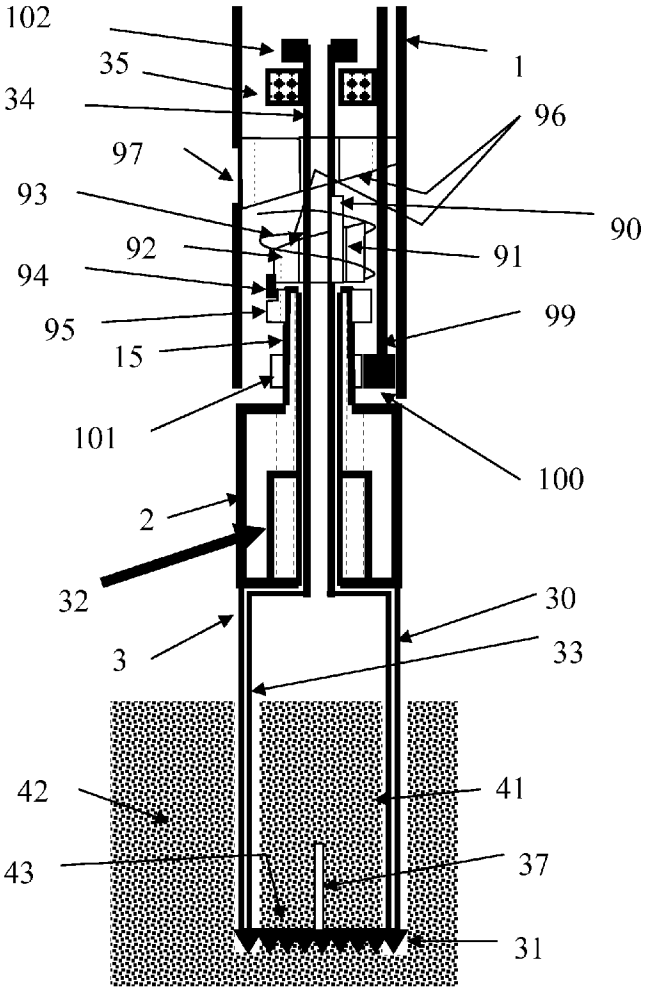

FIGS. 10*a* and 10*b* detail the method by which the inner core barrel can be rotated in order to shear the core from the formation. During coring, the cored rock should not rotate. The internal barrel 33 should not rotate and the cored rock sample 41 is attached to the rock formation 42 by the bottom interface surface 43 of the core. However, with simple core system, the tool-face of the internal core barrel may be unknown and may also shift with coring process.

With this new invention, the coring machine is able to lock the tool-face of the internal tube of the core during coring process. Furthermore for certain tasks, the machine can also impose rotation to this internal core barrel when required.

With the preferred construction of the coring machine, the tool-face of the internal static tube 33 is maintained constant in reference to the tool-face of the machine body, thanks to the shaft 34 which extends inside the rotary head 2 and its rotary shaft 15. The upper extremity of this shaft 34 can be equipped with a key 90 which slides in a groove 91 of the core orientation reference block 92. An axial movement can be imposed on this block 92 and it can either be held rigid with the machine body 1 or with the rotary shaft 15. The axial movement can be imposed by an electromagnet 93.

The locking of the block 92 to the shaft 15 can be achieved with a downwards movement so that a tooth 94 engages in a recess of a disk 95 attached to the shaft 15.

When moved upwards, the block 92 is linked with the machine body, following only one tool-face. In a preferred embodiment, the tool-face of the internal tube 33 of the coring tool always engages the same tool-face, before and after re-linking to the tool body via movement of the block 92. This unique tool-face orientation can be easily achieved by using inclined contact interfaces 96 for the shoulder between the orientation reference block 92 and the machine body 1. Such technique is commonly used to impose a single orientation to fishable "measurements-while-drilling" apparatus (such as SLIMPULSE by Schlumberger). It should be noted that the angle of the inclined contact interfaces needs to be sufficient (probably above 45 degrees) for proper accuracy of orientation. Other systems based on a tooth can also be considered.

Due to the series of attachment between the orientation reference block 92 and the internal tube 33 of the coring tool, a tool-face offset exits between the coring machine tool-face reference and the internal barrel 33. The slot 37 of the internal barrel can be considered as the tool-face reference for the core. A external marking, or groove, 97 is present on the external body of the coring machine: this marking refers to the low side of the inclined contact shoulder 96. The offset 98 has to be determined at surface after the installation of the coring tool to the coring system.

Figure 11B:
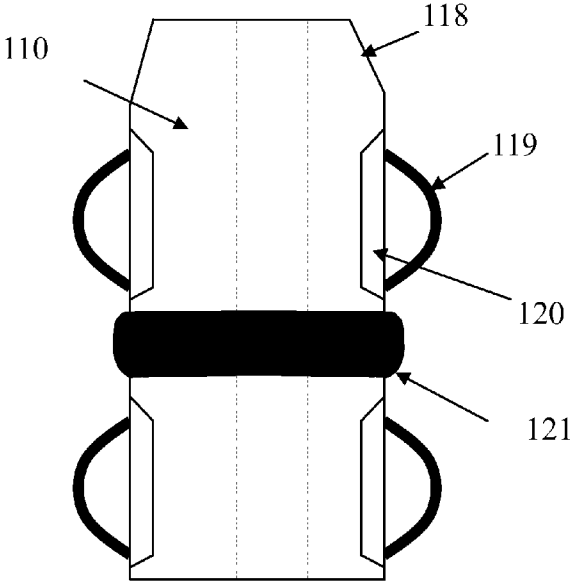
FIG. 11*b* details the spacer/protector block.
Figure 11A:
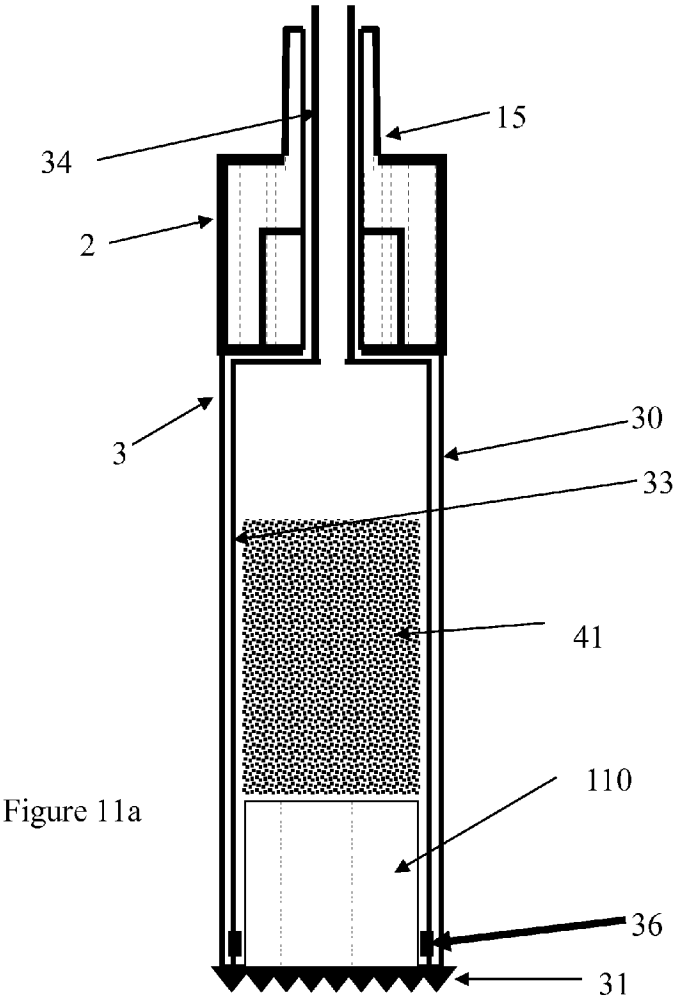
FIG. 11*a* shows the core barrel containing a core and a spacer/protector.

FIGS. 11*a*, 11*b*, 12*a*, 12*b* and 13 show the installation of a spacer or protective layer at the bottom of a core. After retrieval of the core out of the cored hole, the core 41 is contained in the core barrel 3. In some circumstances, it can be highly beneficial to protect the bottom face of the core with a separating/protection layer 110, for example a stopper below the core (FIG. 11*a*).

FIG. 11*b* details the separation materials 110. This separation block has a large chamfer 118 on its top to facilitate installation into the coring tool. It is equipped with centralization mechanism such as bow spring 119 to keep it centralized in the bore of the guide hole 112. These bow springs can become flush with the outside surface of the separation block owing to the recesses 120. A seal 121 would protect the core from the well fluid after the insertion of the separation block 11 into the internal tube 33 of the coring tool.

Figure 12B:
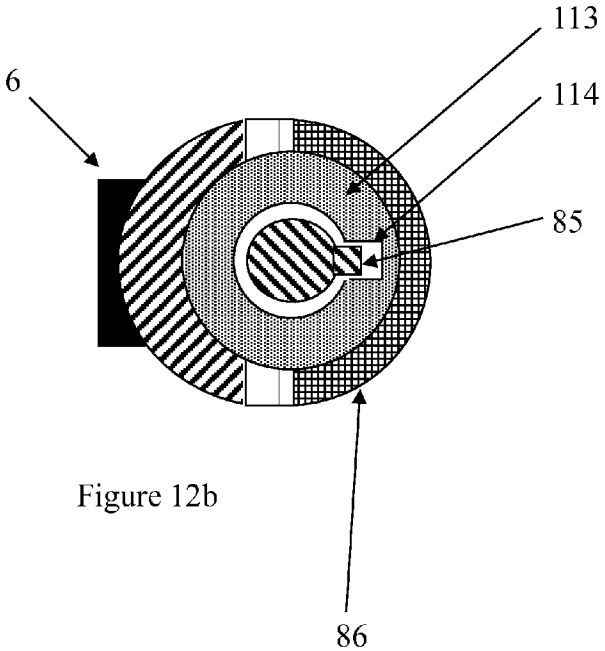
FIG. 12*b* shows the trap key ring construction which enables the coring tool to open the trap door to the storage hole.
Figure 12A:
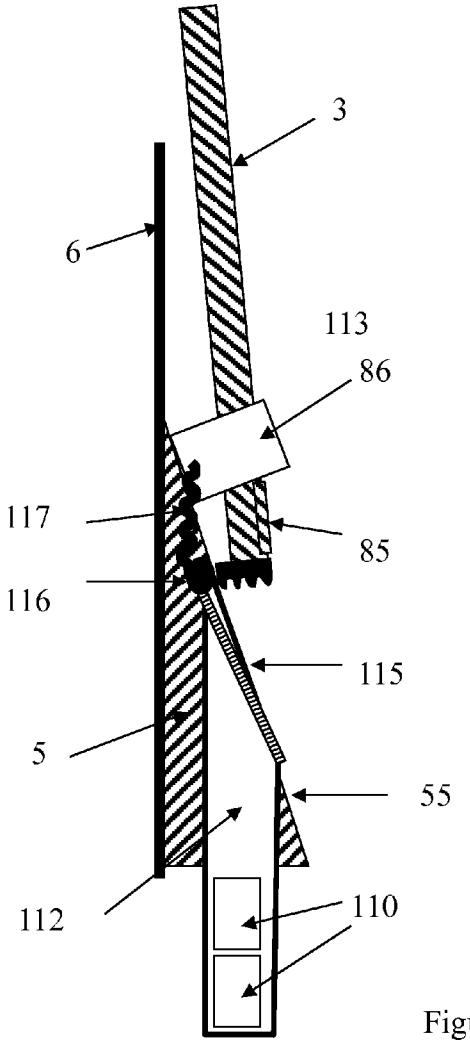

As is shown in FIGS. 12*a* and 12*b*, the deviation guide can be modified to include the separation materials 110. This material can be stored in a hole 112 in the guide. The bottom of the coring tool 3 can engage in this hole. For example, the coring tool is equipped with key or tooth 85 and is pulled backwards in the "trap key ring" 113 of the crown 86. The "trap key ring" 113 is equipped with grooves (or teeth) 114 to allow engagement with the key or tooth 85 of the coring tool. This construction allows the bottom of the core barrel to link to some elements of the guide and rotate them.

After the key engagement, the coring tool 3 is rotated several turns to open the trap 115 on top of the guide hole 112. The trap 115 rotates around its hinge 116. The rotation of the "trap key ring" 113 is transmitted to a movement of the trap 115 via a screw mechanism 117.

Then, the core barrel 3 is lowered in contact to the guide 5: the bottom extremity of the coring tool can then engage into the hole 112. The coring tool is pushed forwards to engage over the separation material 110. To facilitate this operation, the core pinching mechanism 36 can be opened and then re-closed onto the separation material.

Figure 13:
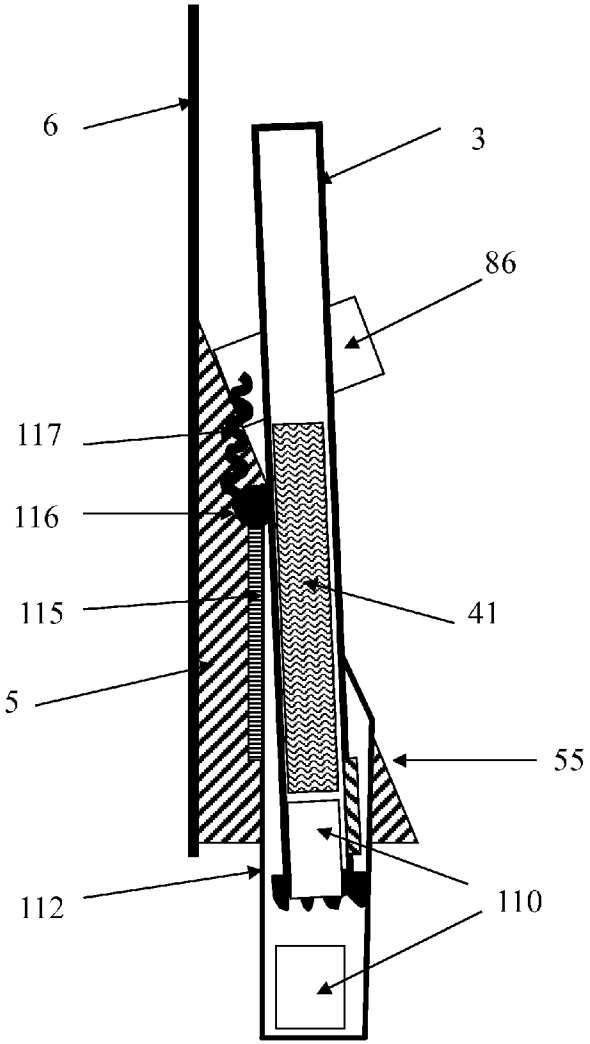
FIG. 13 shows the coring tool engaged in the storage hole.

FIG. 13 shows the results when the trap 115 is opened, the coring tool 3 is engaged in the guide hole 112 and has captured a separation block 110. The core 41 has moved upwards in the coring tool by the length of the separation block 110.

Figure 14B:
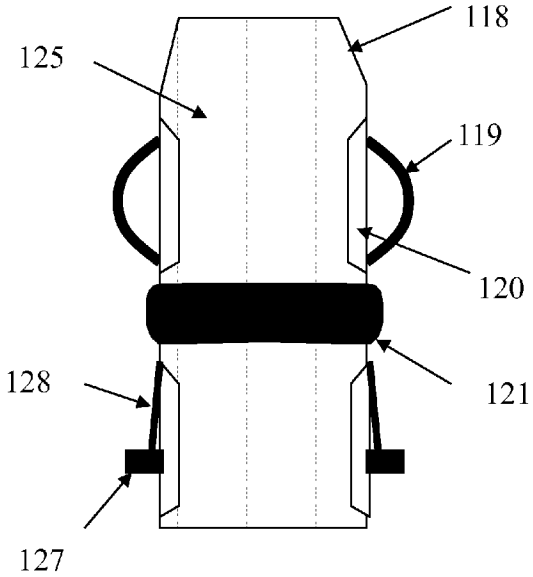
FIG. 14*b* shows a plug, which can be used in place of a spacer.
Figure 14A:
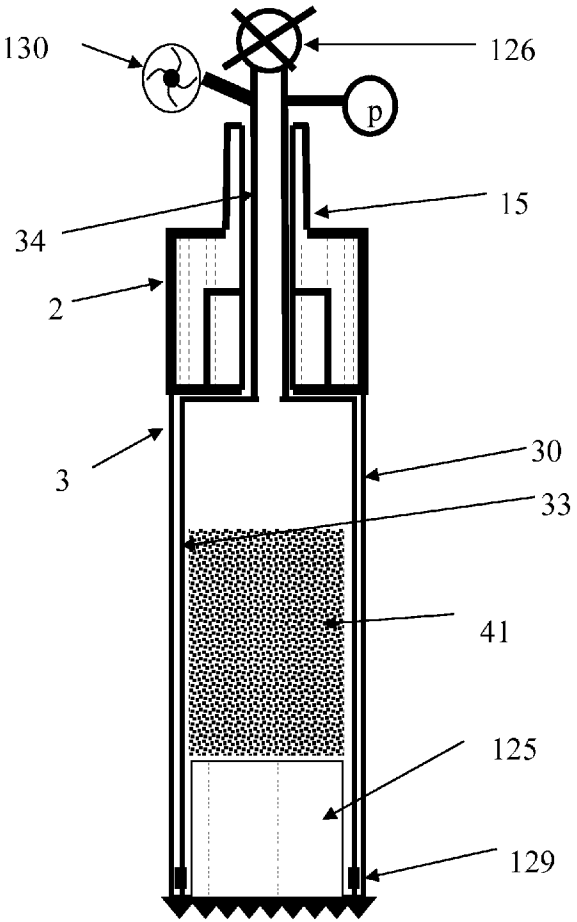
FIG. 14*a* shows a modified core barrel to permit a pressurized core to be retrieved at the surface.

FIGS. 14*a* and 14*b* show a system for retrieving a pressurised core to the surface. In this case, the core barrel can be plugged positively at both extremities. With such a technique, the core will lose no fluid during the trip to surface. The pressure surrounding the core also stays at a higher level. With such a method, the properties of the core (pore and facture) as well as fluid content will have minimum change during the trip to surface (as well as storage in the core barrel).

To achieve this objective, the separation material 110 is replaced by a plug 125 with strong seals 121. The internal pressure generates an axial force which tends to eject the plug 125 out of the coring tool 3. The mechanism to support this axial force is composed of radial dogs 127 which engage in a circumferential groove 129 of the internal tube 33 of the coring tool. These dogs are pushed radially by the springs 128. This plug would be installed in guide hole 112 in place of separation material.

A valve 126 is installed at the top of the core barrel. With the proposed design of plug, this valve closes the tube 34 which supports the internal static tube 33 and can be installed in the shaft supporting the rotary head or the orientation mechanism of the internal static tube 3). The tube must be stronger for this pressure-containing function.

It is possible to keep the pressure inside such core barrel at a desired value. For this function, a pressure sensor 131 below the valve allows monitoring of the pressure surrounding the core. A pump 130 inside the coring machine can be activated to compensate for any loss of pressure during the retrieval of the core out of the well due to cooling effects.

Figure 15:
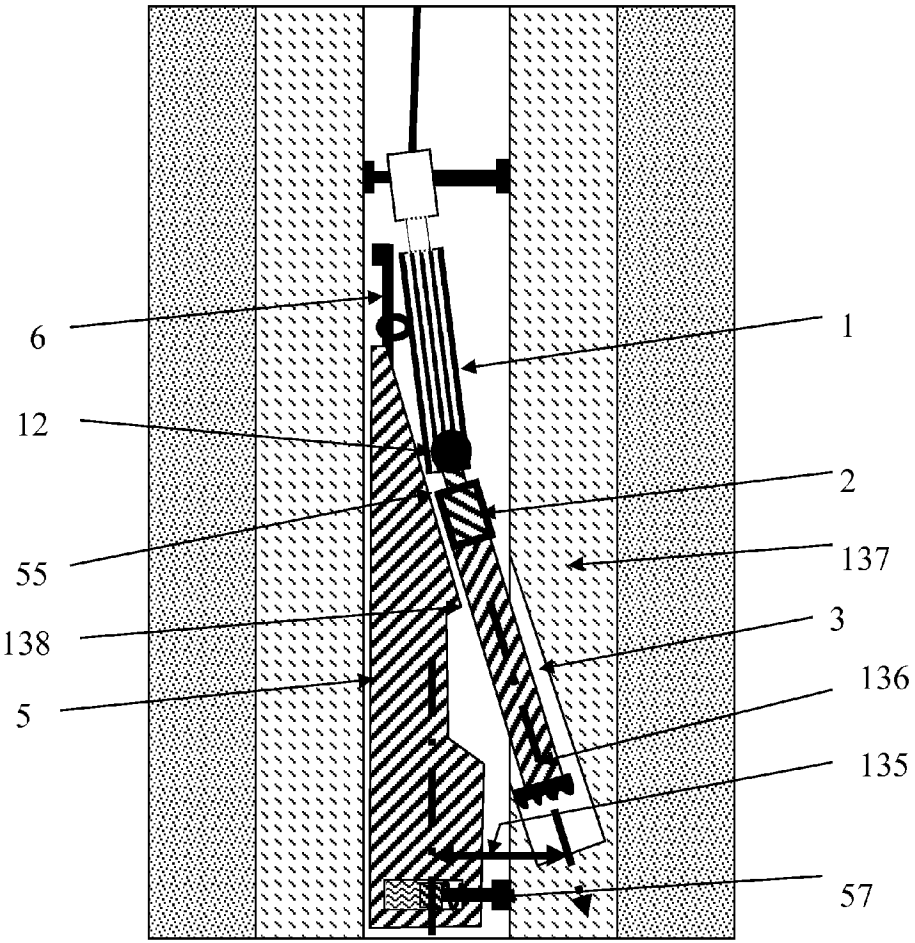
FIG. 15 shows the coring apparatus whilst in operation.

The coring tool should undergo no (or limited) bending (FIG. 15). If this is not respected the core of a rigid formation can be fractured by the bending effect, while rock from an unconsolidated formation would be reduced (at least partially) to powder. To minimise the chances of this happening, the coring tool 3 should move in a straight direction 136 which should be essentially parallel to the surface 55 of the deviation guide 5. This can be achieved easily by the use of a short coring tool (less than 6 ft, for example).

The deviation guide does not need to cover the whole well-bore. At a minimum, it must support and guide the coring tool near the entry into the formation. Its edge 138 is typically at a distance of one diameter of the coring tool away from the wall of the well. With this distance the cutting teeth 31 of the coring tool 3 are not in contact with the guide 5, avoiding mutual damage.

The new coring machine can insure that the rotary head is always kept properly aligned with the core barrel, even when the coring machine progresses on to the deviation guide. This is achieved by substantially continuous adjustment of the tilting mechanism 12 of the rotary head 2.

Figure 16:
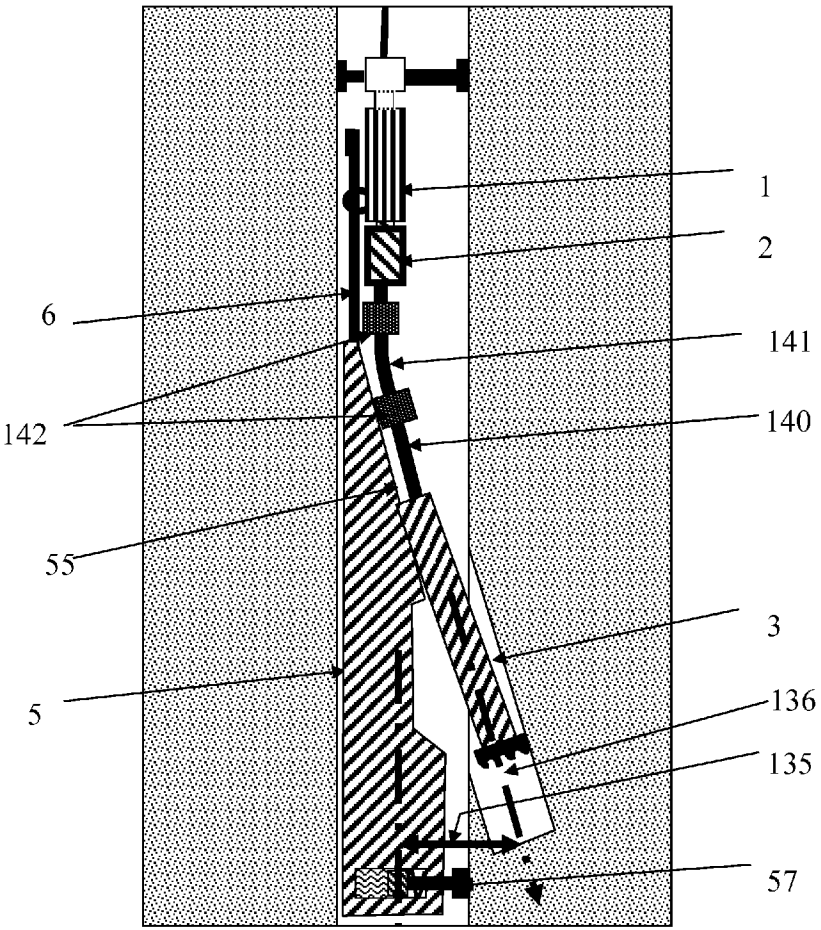
FIG. 16 shows a modified apparatus that avoids the adjustment of the rotary head tilt.

FIG. 16 describes a method to avoid this adjustment of the rotary head tilt. A transmission shaft 140 is inserted between the rotary head 2 and the coring tool 3. The shaft is primarily bent in the zone 141. This point is initially close to the coring tool at the beginning of the coring progress, and it is close to the rotary head at the full penetration of the coring tool in the formation. The shaft is made of a relatively small section pipe which insures bending flexibility. This shaft may be equipped with stabilizers 142 to insure proper alignment of the two axes during the coring process.

With such a configuration, the transmission shaft should be as long as the coring tool. Also, the deviation surface of the guide should be as long as the coring tool.

Figure 17:
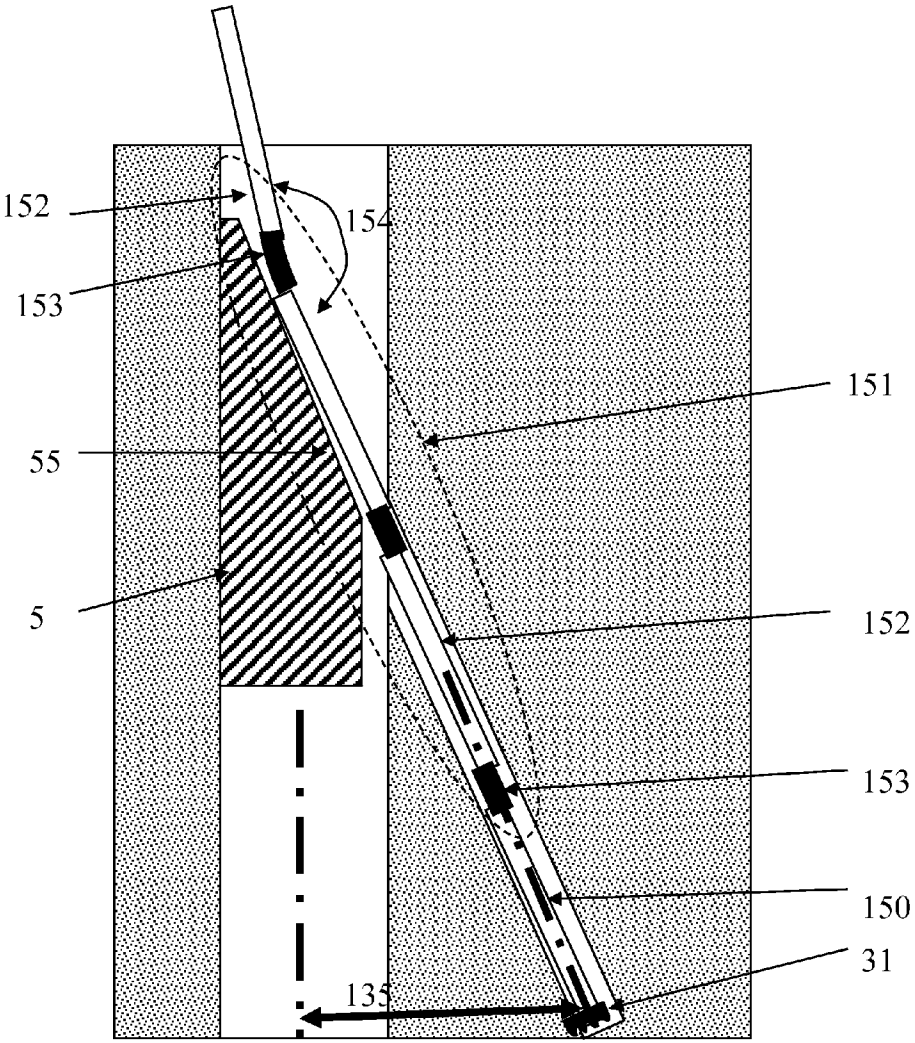
FIG. 17 shows a coring tool with a combination of rigid and flexible sections.

The new invention permits cores to be extracted from deeper (radially more distant from the well-bore) in the formation as shown in FIG. 17 when a combination of rigid and flexible sections in the coring tool are used. The distance 135 can be increased to several feet depending of the chosen method.

The primary element of this solution is a coring tool made of two sections. The bottom section 150 (up to 10 feet) is rigid as with a conventional core barrel; the upper section 151 part, however, is flexible in bending (typically up to 90 ft). The bending flexibility can be either flexible over its length or by alternating rigid 152 and flexible 153 sections (such as a knuckle joint). The length of the rigid section 150 and 152 should be equal or less than the length of the surface 55 deviation guide 5.

With such a tool, the coring tool is always properly aligned onto the deviation guide before entering in the formation. This insures that the coring tool progresses in a straight direction into the formation, with the deviation corresponding to the angle of the guide. It should be noted that the deviation angle is typically in the range of 4.5 degrees.

The flexible coring tool can be constructed from two thin tubes (a rotary external tube 30 and a static internal tube 33) made of flexible material (with a low Young's modulus). Preferred materials include BeCu, Ti, or composites (fiber and resin).

Figure 18B:
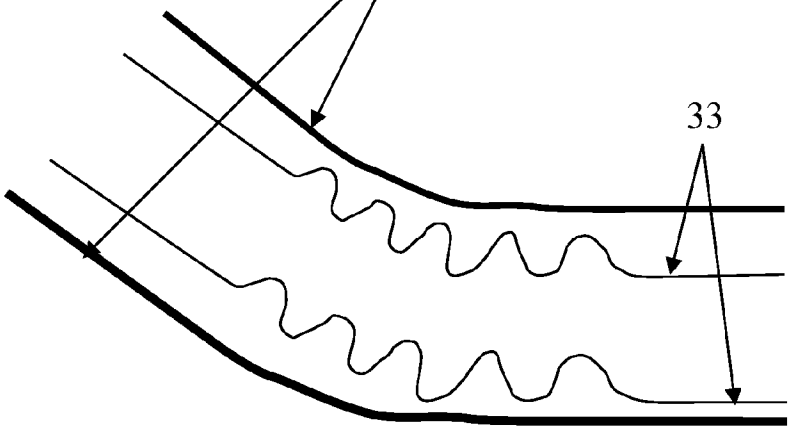
FIG. 18*b* shows the shape of the bend section of a coring tool with flexible sections.
Figure 18A:
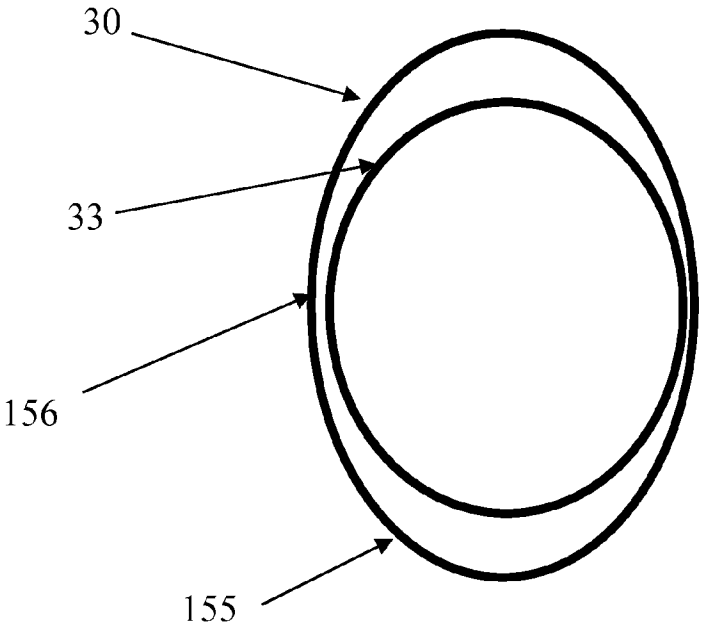
FIG. 18*a* shows the oval deformation of the external tube in a bend section.

FIGS. 18*a* and 18*b* show the shape of the bend section. The bending requirement 154 is the angle of the guide over a distance typically of 1 ft. The rotary external tube may deform slightly elastically to form an oval shape in the bent section. The oval deformation 155 may nearly close the gap 156 with the internal static tube of the coring tool.

For the internal tube, the section should not be modified under bending so that the core does not have to modify its section. Cuts may also be added in the tubes to insure more bending flexibility. No (or minimum) torque is transmitted to this tube. In some applications, this internal tube does not need to insure hydraulic sealing: if such a requirement is present, the cuts may be sealed by an extra intermediate sealing layer, or a bellows-type surface may be induced in the tube. The bellows shape 157 can be a spiral so that the flow between the 2 tubes can easily be insured.

With this embodiment of coring barrel, the core is initially straight during the drilling process. However, when the coring tool is retracted out of the formation, temporary bending is imposed in order to re-align to the axis of the main well. This bending is also imposed onto the cored element. Depending of the properties of the core, this can have negative effects such as cracking in the core or compression of the pores. In the instance that the coring tool is made of rigid/flexible sections, it may be advisable not to use the core in the bending section for analysis. Typically 6 ft are kept straight while 1 ft of core is submitted to bending effect (and the associated perturbations).

If the coring tool is made of a rigid bottom part and flexible upper part, the bending is distributed over a long distance, so that the perturbation may be negligible. However with extremely sensitive rock, perturbation may be induced over the long section: but the bottom section (typically 6 ft) will be fully conserved.

The rigid and flexible coring tool can be modified to steer the cored hole away from the main well (FIGS. 19*a* and 19*b*) in a curved trajectory. With such a design, it is possible to increase the distance 135 between the end of the cored hole and the main hole. For example, with a 30 ft coring tool, this distance could reach 5 to 10 ft.

For this application, the coring tool described above is modified, so that the coring tool has a natural tendency to bend in one plane. This is achieved by inducing permanent bending in the section 153 of the previously described design.

Referring to the coring tool with rigid 152 and flexible 153 sections, the internal static tube 33 has permanently induced bent in the flex zone 153: this tube has the natural shape 160.

When this pre-bent tube 33 is engaged in the coring tool 3, it induces a bending in the external rotary tube 33 so that the coring tool 3 has a shape similar to the internal static tube (with smaller bending, as the external tube 30 resists the imposed bending by the internal tube 33).

Figures 19A, 19B:
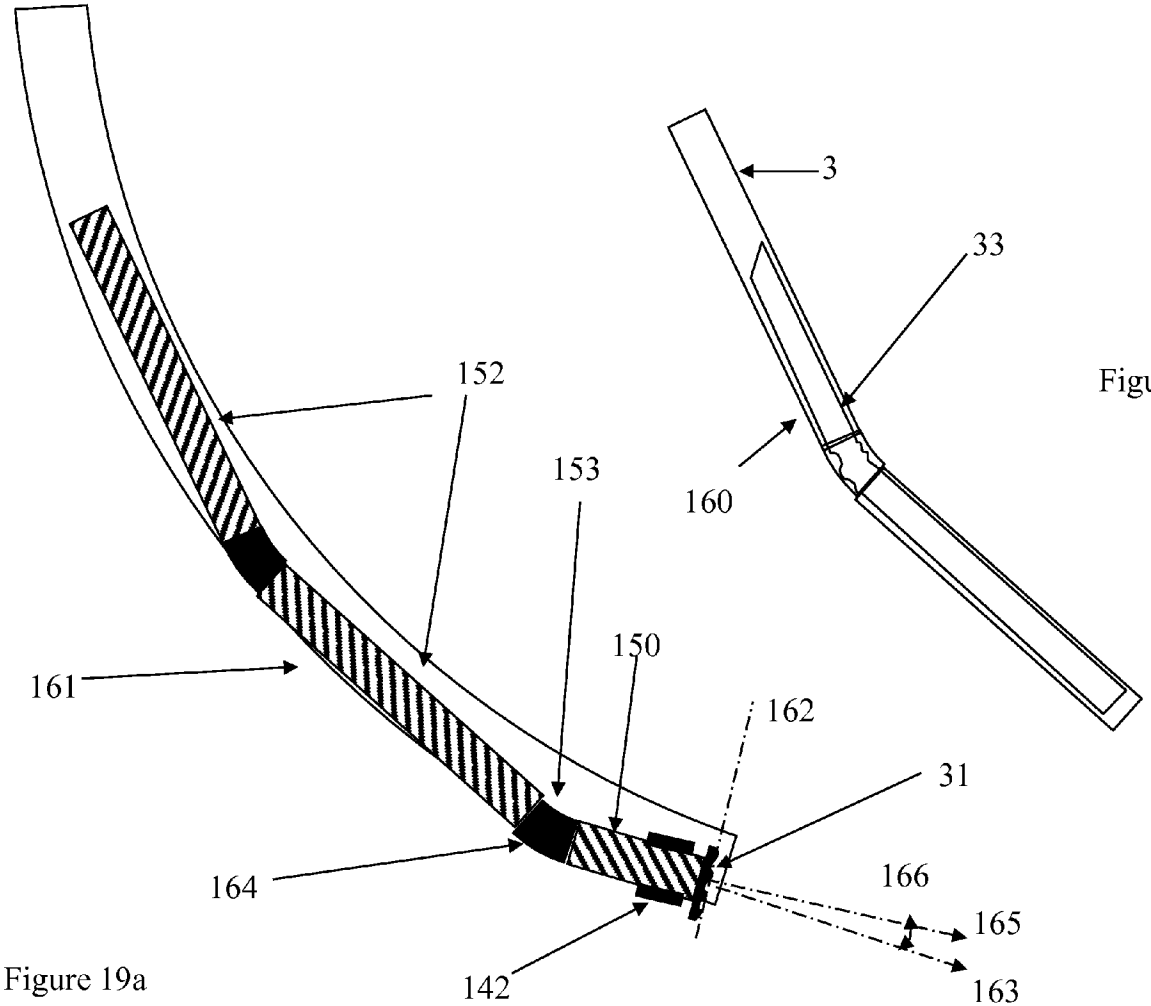
FIG. 19*a* shows the coring tool can be used to steer the cored hole away from the main well in a curved trajectory.
FIG. 19*b* shows the shape of the pre-bent internal tube inside the external tube in the situation shown in FIG. 19*a;*

The coring tool would then be in the core hole as shown in FIG. 19*a*. The hole has a natural curve 161, as the bit face 162 is not perpendicular to the hole axis 163 at the bottom and the coring tool is touching the hole wall at the first bend 164.

The theoretical build angle corresponds to the angle 166 (between bit axis 165 and hole axis 163 at the end of the hole, divided by the length of the first straight section 150. The build angle is very small with the typical geometry for coring system.

For example, for a hole size of 2.5"; coring tool outer diameter of 2,0"; length of the first straight section of 3 ft, the build-up rate in this instance could be in the range of 0.36 degrees per meter. For a coring of total length of 30 ft, this change in deviation is 3.6 degrees. This corresponds to double the distance 135, so that it can reach up to 5 ft from the main hole (with a 30 ft coring tool).

During coring process the internal tube 33 is kept static, so that the plane of bending is kept essentially constant. The external tube 30 rotates and drives the cutting process via the teeth 31. It should be noted that the section 150 is normally half the length of section 152 for proper installation in the curved hole 161. The rotary tube 3 experiences friction with the bore hole at the bend points 153. Also there is friction between the internal static tube 33 and the external rotary tube 3 at the same bend point. The bend of the internal tube 33 may be locally coated for better resistance to erosion.

The shape of the coring tool 3 in the curved cored hole 161 is initially imposed by the bending effect of the internal tube 33. Furthermore, a buckling effect will reinforce the tendency.

It should also be noted that an optional "near-bit stabilizer" 142 (or blades) may have to be installed at a short distance from the bit to insure the proper guidance of the bit in the curve hole. Its dimension needs to be compatible with the design criteria of directional drilling.

Figure 20:
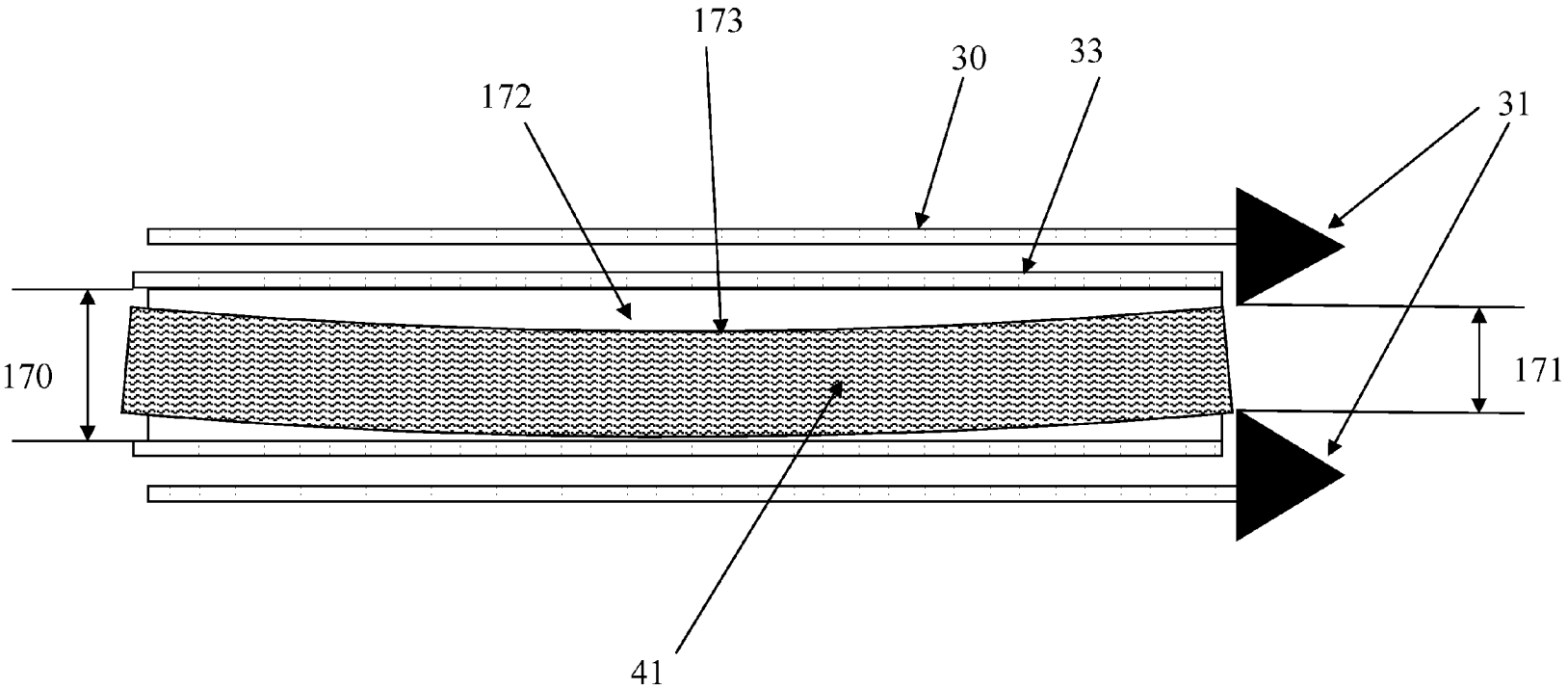
FIG. 20 shows the diameter of the core and the natural bending within the core barrel.

FIG. 20 shows the diameter of the core as well as its natural bending: The internal static tube 33 has an internal diameter 170 larger than the internal diameter 171 of the coring crown made by the teeth 31. This insures that the diameter of the core 41 is smaller the internal tube 33. A deformable lining 172 of the tube 33 insures that the core does not rattle in the core barrel. The curve 173 may be measured in the laboratory as verification of the achieved build-up for the cored hole.

Figure 21:
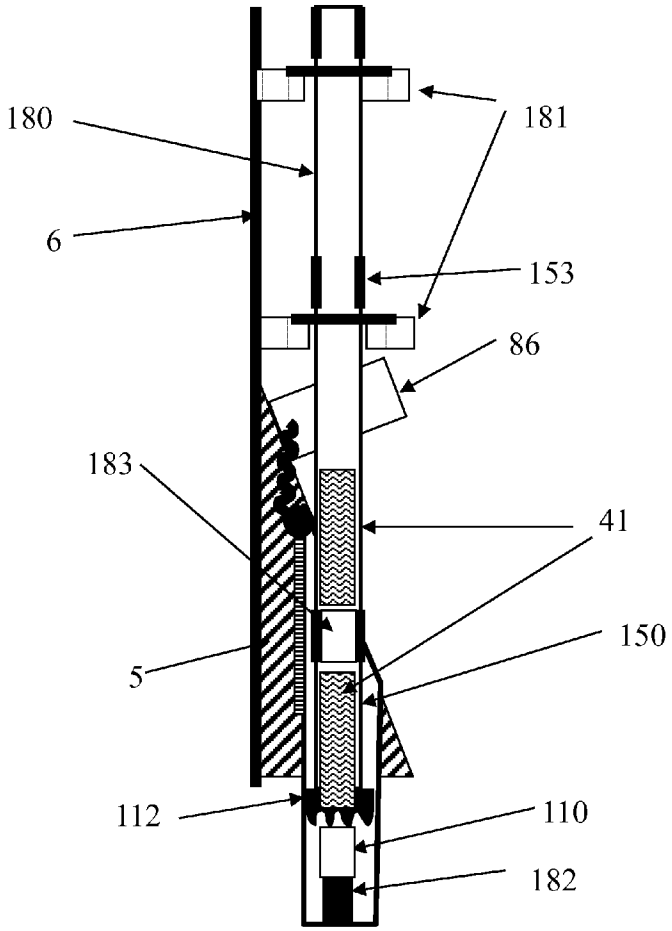
FIG. 21 shows the installation of a spacer into the core barrel when flexible sections are used in the core barrel.

In FIG. 21, the pre-flex coring tool 180 is maintained straight in the main well bore thanks to distributed guidance systems 181 attached to the telescopic structure 6.

The use of this pre-flexed coring tool needs special procedure to insure the core moving up the core barrel does not pass through a bent section. Each time that the coring process has progressed by a length equal to the length of the first straight section 150, the new core reaches the first bend. The coring tool then has to pull out of the cored hole and be brought back in the main well into a straight position. Only in this straight position should the new core be pushed across the flexible section (which is currently being held straight) into other straight sections (ideally against already stored cores).

This pushing upwards can be performed as following:

The coring tool is engaged in to the deviation guide 5 (as explained for the process for introducing a spacer—FIG. 13).

A spacer 110 is added at the bottom of the core to insure protection and also insure that no other cores would installed later in a bend section 153 of the coring tool. To insure this length definition, proper measurement of axial displacement is required during coring process, as well as loading the spacer from the guide.

Then, the coring tool is pushed downwards into the hole 112, so that the stopper 182 (supporting reserved spacers 110) pushes the cores upwards inside the coring tool. These cores are separated by core spacers 183 previously installed.

With such a displacement during this push, the cores never pass through bend of the coring tool. They are also always contained in straight section of the coring tool. This avoids damage of the core.

For downhole core analysis, weight-on-bit (WOB) and torque measurements can be made by the coring machine during the coring process. Combined with coring rate of penetration (ROP), these parameters allow computation of rock mechanical parameters, allowing determination of change of rock properties. For proper cutting torque evaluation, it is important to first measure the torque when the cutting tool is not touching the bottom: this is the rotary friction torque due to the small clearance involved with coring tool.

This method to determine rock characteristic from drilling parameters is more accurate than the result achieved while drilling the well with a conventional drill bit, as the cutting only occurs at the same condition (tangential linear speed in particular during coring; but with a conventional drill bit, the cutting parameters are dependant on the position under the bit face).

Reverse circulation can be used to circulated the cuttings into the small annulus between the rotary tube and the static tube. The flow is loaded with cuttings generated by the cutting teeth. These cuttings finally reach the internal chamber of the coring tool. Cuttings size analysis can be performed by, but not limited to, ultrasonic means, density measurements and filtering associated with a filter cleaning method. Several of these methods can be combined for more accurate determination of cuttings characteristics. Using this analysis in conjunction with the penetration in the cored hole allows characterization of mechanical properties of rocks, especially if this analysis is associated with WOB and torque measurements as previously described.

With this coring process, the cuttings are not transported over a long distance, avoiding damage and modification of the cuttings during the transport process.

Figures 22A, 22B:
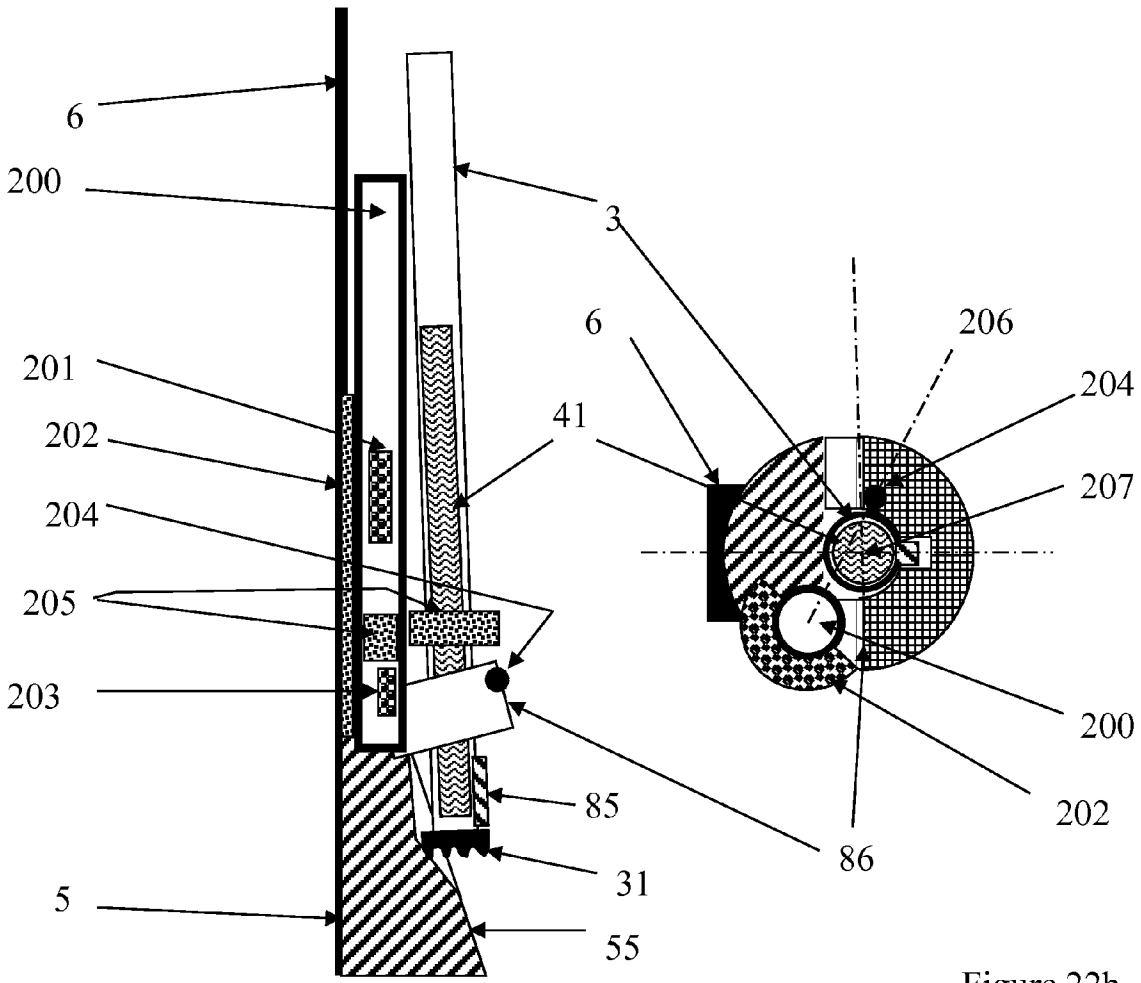
FIG. 22*a* shows the downhole logging tools used for analysing the core whilst in downhole conditions.
FIG. 22*b* shows a cross section of the same shown in FIG. 22*a;*

A system for down-hole logging of the core in down-hole conditions is shown in FIGS. 22*a* and 22*b*. The deviation guide can be instrumented with sensors similar to open-hole logging, so that direct logging information can be determined on the core before the core is submitted to the perturbations due to change of temperature and pressure while "tripping" out of the well, as well as risk of lost of pore fluid during the trip out and storage.

For this objective, the deviation guide may be equipped with a chamber 200 which supports and/or contains detectors and associated control electronics. This chamber can be integrated in the guide; or it can be a small logging tool parallel to the coring tool when exiting into the main well from the cored hole. When the core is pulled backwards in the main hole, the core is passing in front of the detectors, allowing analysis of the core versus the core axial position. The core can be rotated during the logging process for either imaging or tomography purpose.

As detector, a gamma-ray detector 201 can be used to determine the natural radio-activity of the core. This detector may be based on scintillation crystal associated with photomultiplier tube. A shield 202 may be installed on the backside of the detector (and even around the core) to limit the perturbation of the measurement by surrounding rock (which may-have a very similar characteristic as it may be the same rock). The shield may be made of lead or any heavy metal. Also, it is advisable to measure the noise background at this depth without a core in the coring tool: this noise can then be subtracted from the reading when a core is present in the coring tool.

Gamma-ray measurement allows to verify that the core has been taken form the proper formation. This can be critical in complex or fracture geology or in the proximity of fault. This type of control is also vital when coring form horizontal main well, while the cored hole is directed upwards or downwards: it is vital to insure that the core is taken form the proper formation.

This measurement is a direct quality control of the process: in case of inadequate core extraction, it can be immediately decided to take another core, especially if multiple short cores are being taken.

The logging system can also be equipped for gamma-gamma density, using a gamma-ray radio-active source (typically Cs132), as typically performed with wireline logging tool. The density can be measured by back-scattering, allowing the source to be installed on the same side as the detector (everything is in the logging tool). However, it would be possible to install the gamma-ray source 203 on the opposite side (in the guide for example) of the gamma-ray detector 204 inside the logging tool.

It should be noted that the natural gamma-ray measurement may be perturbed by the presence of the gamma-ray radio-active source. Enough distance and shielding 205 should be allowed to limit the perturbation.

With the density measurement, the measurement can be performed with the core in rotation (by rotation of the coring machine). This allows the anisotropy and non-uniform density in the core section to be determined. This analysis can even become a scanning process (tomography) with the preferred design:

Source and detector on opposite sides of the core.

The line 206 passing from the source 204 to the detector 203 does not pass through the center 207 of the core 41.

The tomography resolution can be improved by using a second illumination cord: this can be achieved by one of the following systems:

Use of a mechanical feature which allows the coring tool to be displaced sideways. Core tomography can then be performed twice, corresponding to the two illumination paths.

Use of a second density detector in the logging tool to perform the measurements following two illumination cords across the core.

Density measurements and tomography measurements are important information for core characteristic calibration under initial down-hole conditions such as pressure, temperature and pore fluids.

Figures 23A, 23B:
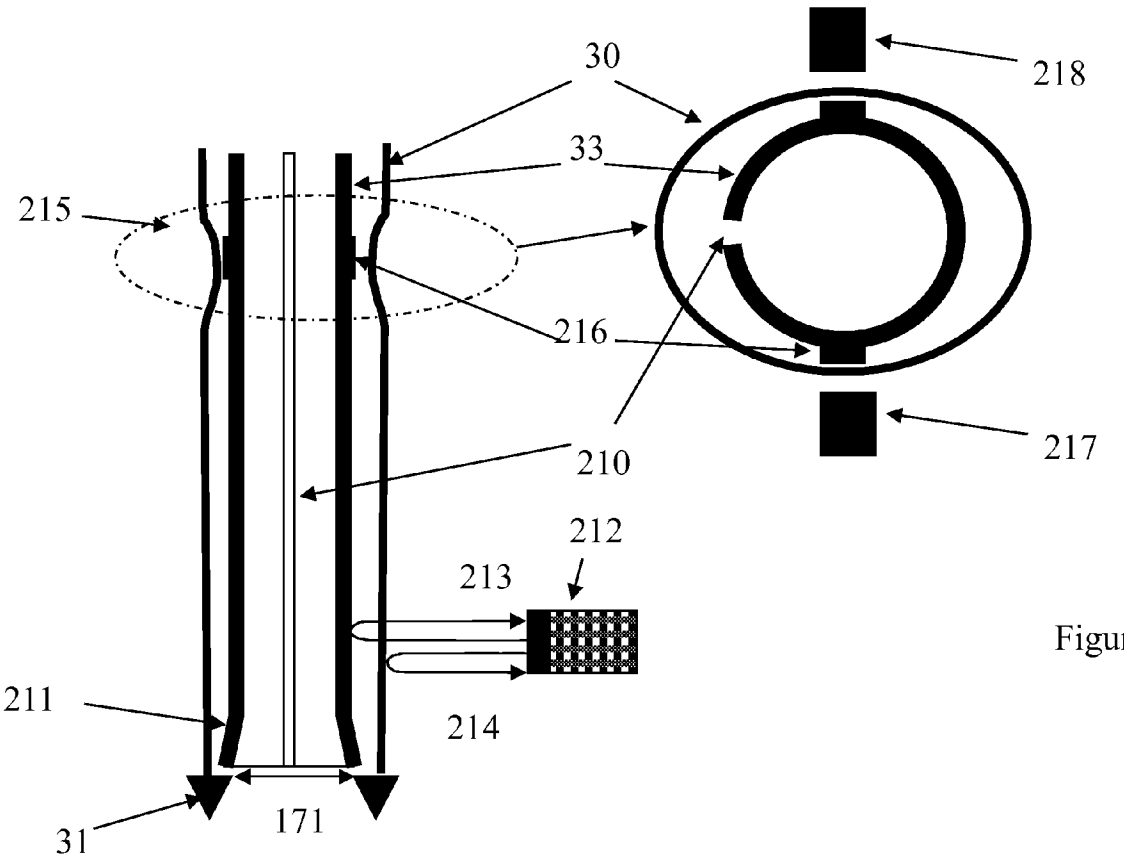
FIGS. 23*a* and b show methods of determining the core diameter within the core barrel.

Another proposed downhole measurement proposed by this invention is the core diameter (FIGS. 23*a* and 23*b*). It is normally supposed that the core diameter equals the internal diameter of the cutting edge of the coring tool. However, due to mechanical damage, this may not be the case. Furthermore, the core geometry may be changing with time (after being subject to wetting with inadequate fluids), change of pressure and temperature. Analysing the core diameter at different conditions (for example just after coring, at the surface and in the lab) is a good quality control parameter for the "aging" of the core.

This measurement can be performed by different techniques. In one design, the internal static tube 33 may be equipped with an axial groove 210. This tube may be slightly smaller than the internal diameter 171 of the cutting teeth 31, so that the core has to open the internal tube 33. A conical section 211 helps this opening effect when the core is pushed upwards into the tube 33. When the internal tube 33 is opened by the core, its groove 210 is also wider, as well as its overall diameter. The change of the diameter of tube 33 can be determined by external measurements. As one of the preferred methods, the gap between the two tubes 30, 33 can be measured by a ultrasonic transducer 212 (pulse-echo method or decay of resonance): the measurements would consist of the times of flight for the two acoustic paths 213, 214. The difference between these two measurements multiplied by the acoustic velocity in the fluid allows the determination of the gap.

Another measurement method is based on mechanical effect in section 215. In this section, the tube 33 is slightly oval. It is in contact with two protuberances 216 attached to the internal cut tube 33. When the tube 33 is deformed by the core, the protuberances 216 deform the external pipe 30. The direct determination of the ovality of tube 33 allows to determine the diameter of the tube 33. This ovality determination of pipe 33 can be achieved via a pair of distance (or displacement) sensors 217, 218 attached onto the guide at the opposite diameter of the coring tool. Several type of detectors can be used: LVDT sliding in contact of the surface, or ultra-sonic sensor as described just above, or eddy current sensors. For this application, the external tube 33 would have oval sections at certain axial position. During diameter logging, the coring tool 3 will be rotated slowly when the sections 215 are in front of the detectors 217 and 218.

Thermal characteristic of the core may also be logged. For this measurement, the core temperature is changed by an external heating or cooling action. The evolution of the temperature versus the application of the perturbation is measured, the temperature response to the heating step function, allows to determine the specific heat and the thermal conductivity of the core, supposing know the insulation to the well bore. This core specific heat and conductivity are in relation with lithology, porosity and fluid properties.

A possible design for such a logging is to install a heater for the pumped fluid in the coring tool, allowing hot fluid to circulate in the annulus between the two tubes 30, 33 of the coring tool. The core response is measured by the logging system via temperature probe or heat flux probe in contact to the external surface of the coring tool.

The heating effect could be achieved by a current induction method in the core, under controlled current generation. Current induction in the coring tool 3 and the core 41 can be directly imposed by magnetic induction when AC current is transmitted into a static winding attached to the guide. Another method for current induction is to generate eddy current (or Foucault current). This can be achieved by installing large static magnet near the guide and when the coring tool (and core) is rotated in front of the magnet, eddy currents appear in the metal of the coring tool and the core.

The heating by induction method can be modified to induce less current in the coring tool body and more current in the core itself. To achieve this, the two tubes of the coring barrels need to be made of non-magnetic and ideally resistive material: Nickel metal of stainless steel metal can be an acceptable solution. The thermal response logged by the thermal probe is then dependant of the core resistivity. Then amount of heating would then be detected by the amount of induced current in the core volume.

Core resitivity could be logged, but requires more modification of the coring tool. For example, induction resistivity of the core can be performed by passing the core barrel through two coils: the coring tool should ideally be non-magnetic and highly resistive. The coring tool may have to be constructed of composite material (such as fiber glass and epoxy resin).

With rock mechanic science, the Coulomb failure criteria defines the rupture criteria of the rock: the required level of shear to reach rock rupture increases with the compression stress in the plane perpendicular to shear.

The coring machine according to the invention can allow this determination. The coring tool is engaged in the formation during any coring process. Then the coring tool rotation is stopped; the core is pinched (refer to FIG. 4); then the internal tube is locked on the external tube (refer to FIG. 10). The rotary head 2 applies torque to the coring tool 3, while torque is being measured: The torque is slowly increased until rupture of the core face 43 of FIG. 10. After rupture, the torque immediately reduces. The peak torque during the torque increase phase corresponds to the rupture torque for the rock. For improved rupture torque determination, the residual torque at low rotation speed after the rock failure is measured, so that it can be subtracted for the peak torque (as being only friction torque).

An approximated relation allows an estimation of the average shear torque at the shear surface 43 to be made. The knowledge of the shear modulus would improve this estimation. During the test of core shearing, the compression load on the face can be imposed by the coring machine as WOB. The compression stress can be directly calculated using the compression force: and this in turn allows determination of one point of the COULOMB diagram.

After the first test of core shearing, the normal coring process can be restarted for a short penetration. Then, the a new core shearing test may be perform for another axial load (WOB), allowing to determine another point of the Coulomb diagram.

Normally two points are sufficient for the determination of this diagram. More points can be taken for more accuracy, as well as directly determining the potential non-linearity of the response of this particular rock.

A special test can also be performed to determine the maximum tensile value of the rock. Again when the coring tool has penetrated enough the rock, the pinching system is activated; the pull force (negative WOB) is applied and measured: this pull force is increased slowly during continuous measurement until failure is reached (and the measurement falls immediately to low value).

The maximum pull force is used to compute the tensile stress corresponding to failure.

The new coring machine can also determine the in-situ stress. It should be remembered that full stress field can reduce to the two principal stresses (oriented at 90 degrees from each other). These stresses represent six unknowns (three amplitudes and three directions).

To perform these measurements, the cutting teeth 31 of the coring tool 3 are modified with two rows of cutting edges. The first edge cuts an internal diameter. The second edge cuts an internal diameter which is smaller than first diameter. Over a short length, the core has a slightly bigger diameter than the core entering in the coring tool.

With such an end core shape, the surface of failure during core test for shearing or pulling is at the section, as the stresses are higher there than in section of the large-diameter core.

After core failure in section (thanks to process explained above), the coring tool is grabbing the core at its larger diameter which is still attached to the formation. Then, a new shearing test is being performed to shear the surface. This test gives one set of measurement (WOB, torque) for rupture, allowing computing a data point (shear stress, compression).

This rupture occurs for this shear/compression stress, but combined with the Compression stress in the section due to the naturally present local stresses in this formation. These surface stresses are most commonly compression stresses and are generated by the combination of the principal stresses at this interface.

Using the theory of Mohr circles, the rupture occurs when the larger circles reach the already measured Coulomb's line (determined from failure in small section).

By performing this test twice in a similar or the same cored hole for different WOB, it possible to resolve the amplitude and "tool-face" of this stress in section (tool-face in this instance is the orientation angle of this stress in the section).

To solve completely the problem of principal stresses (three amplitudes and three directions) in the rock, six independent measurements are required: two can be performed as mentioned above (same or similar core hole) at two WOB. Such tests need to be performed in three cored holes oriented in different independent directions. For this objective, the guide needs to be placed in the main well at three different tool-faces while the cored hole inclination cannot be 90 degrees from the main well. This means that the sheared face for rock stress determination (amplitude and angle) will be determined in surfaces corresponding to the faces of a three-faced pyramid. Knowing the stresses on each free face of the pyramid, allows then to determine the equivalent stress in the solid formation. For proper accuracy on angles, the deviation angle of the cored hole should be sufficiently adequate (in the range of 30 degree). For practical application of this objective, this means that the coring tool 3 should be relatively small, so that the guide deviation angle can be large.

Finally, the stress concentration factor for the near cored hole to a distant, non-perturbed formation volume can be determined. This may require estimation of cored hole geometrical defaults, as well as elastic properties (Young modulus & Poisson's Ratio).

For a full solution of the problem, the determination of the elastic properties and poro-elastic coefficient can be determined in the lab using the core for proper lab measurement.

The Young's modulus can be obtained by a buckling test of the thin core. For this objective, the core should have a large ratio of length over diameter. Then the core will not be well supported in the static internal tube 33, either due to a larger internal diameter above the cutting section, or due to the usage of a quite deformable tube 33. Then the machine needs to be modified so that axial load can be applied on the upper extremity of the core. This can be achieved by one of the following solutions:

a) short coring tool so that the core reaches the top of the coring tool, b) A pinching mechanism is added to transmit a load onto the core at a certain distance for the bottom extremity of the coring tool c) A piston with seal can be pushed down in the coring tool thanks to application of hydraulic pressure to the upper face of the piston An axial load is applied (and measured) onto the core, increasing slowly from small value, until buckling (EULER formula) is reached. At failure, the axial load is suddenly reduced (this is the detection method). As the geometry and the force are known, the Young's modulus can be calculated.

For the Poisson ratio, a load test of the core can be performed. The basic test determines the tensile strength of a rock as follow: A cylinder of rock is compressed radially between two plates. In this load condition, it is easy to observe that in the axial plane passing by the contact lines with the loading plates, only tensile stress perpendicular to that plane is present. A formula relates this tensile stress directly to the radial load and the geometry (not the elastic properties).

In this invention, the loading mechanism is modified as follows: the parallel plates are set in contact with the rock sample on the tangent contact lines. Then these plates are maintained static. Then a force is applied onto the rock sample following its main axis. This makes the rock sample grow readily due to the Poisson effect. However, in one radial direction the deformation is blocked by the two plates. Then compression contact occurs at the contact between the rock and these plates. Now the rock sample is loaded so that tensile load occurs on the axial plane. The axial load is then increased until reaching the tensile rupture. Rupture occurs at the rupture tensile load (which is know form the previously measured Coulomb failure diagram. Then the radial contact force can be calculated. The appearance of this force is due the contained Poisson deformation generated by the axial loading.

This formula links axial loading, radial loading, Poisson ratio, Young's modulus, diameter and length of the rock sample. In this case, the only unknown is the Poisson ratio, as the axial loading is measured.

To perform this test, the core is again compressed axially (as with buckling test). However, it is radially confined against two tangent planes. It must also be short enough to avoid buckling. In practice, the same tube 33 is used for both tests. The only difference between both tests is the length of the core. For buckling test, it must be long (probably L/D>15) and for the modified test, L/D is in the range of 1.

The core logging process is primarily intended to occur when the core is retracted from the formation: the core slides on the deviation guide and in front of the logging system. This logging is performed at down-hole conditions (pressure and temperature) and also after minimum invasion time.

With a proper design of the deviation guide (and support of the logging tool), the deviation guide can be locked in the well-bore at a different depth (for example just below to the surface). With a corresponding design of the guide, it is possible to pass the coring tool across the guide such that the coring tool is not pushed sideways and stays in the main well. The coring tool can move downwards and then upwards (in a similar method as during coring process), so that the core slides in front of the logging system. In this situation, all the logging measurements can be performed again, but at different environment conditions.

Referring to FIG. 14, the coring machine according to the invention is able to apply pressure to the top surface of the core. This can be achieved by closing valve 126 while operating pump 130. A separating plug as shown in FIG. 13 may be installed initially in the coring tool and could be situated at top of the core.

With such pressure applied, the core is pushed downwards out of the core barrel. This allows to eject the core out of the coring tool, when the core is considered undesirable.

The ejection can be performed inside the cored hole: the core is re-installed in its hole (or any exiting cored hole). This process of core ejection is quite useful when combined with down-hole logging of the core. If after core logging, the core is not desirable, it can be ejected to avoid a trip to surface only for core rejection.

When multiple small cores are stored in the coring tool, it is critical to eject only the undesirable core. This means that core displacement need to be controlled. This could be carried out by a variety of methods, some of which are described below:

a) measure the volume of pumped fluid until proper displacement is achieved.

b) set the coring tool back on bottom in a cored hole, pump the core against the bottom of the cored hole. Keep the pump pressure and move the coring tool out of the cored hole while monitoring the change of depth of the coring machine.

c) use the logging information to determine when the top of the core is passing in front the logging system. This requires to move the coring tool so that the top of the core after ejection of bottom cores is just in front of the logging section.

The special plug shown in FIG. 14*b* can be used for this purpose, as it prohibits backwards movement in the coring tool.

A coring tool with special teeth can cut across casing, cement and then rock. This allows extraction of cores behind casing. Obviously, this process can be combined with all above special usages, applications and system.

For coring behind casing, it is required to cut a window in the casing. This window insures communication between the formation and the well. This may be unwanted after coring. The coring machine according to the invention can plug this hole and window. To carry out this process, a special plug (refer to FIG. 13) can be taken from the guide and ejected into the top of the cored hole. These special plugs can insure some isolation by:

a) Use of swellable material on the outside of the plug. This material will swell after installation of the plug in cored hole.

b) The use of a rubber element on the periphery of the plug. This element will then be tight in the small cored hole thus creating a seal.

c) The plug contains material which sets under proper conditions (e.g. time dependent). This allows the installation of the plug in the cared hole, then the plug is "opened" to let the material come in contact with formation and make a seal.

d) The plug may be "expanded" inside the cored hole for sealing. For example, this can be achieved by rotating an element in the plug (after its ejection) to insure the expansion e) The core hole can be filled by a special fluid which can set. For this objective, a potential method is to lower the coring tool to the bottom of the cored hole. Then the special fluid can be circulated between the two tubes of the coring tool, while slowly pulling the coring tool out of the core hole. This insures the controlled filling of the cored hole with this special fluid. In some cases, a type of cement slurry could be pumped in the cored hole. This special fluid can be lowered in the well in a special container inside the coring machine. When the coring apparatus is lowered down the wellbore by tubing, the special fluid can be delivered to the coring apparatus via this tubing.

The coring machine according to the invention allows down-hole logging of the core to be performed after extraction. It also allows the core to be ejected back in the core hole. Normally, the primary objective of coring is quality control. However, the combination of coring, core logging, core ejection can be used to obtain special logging information of rock without the damage associated with a drilling process. It is also a method to obtain improved data such as density tomography or deep measurement.

The logging tool acquires various types of data. In one mode of operation, this data may be logged in memory (probably inside the logging system). These data will then be transferred to the operator computer at the surface.

In another design, an electrical link is installed between the coring machine and the logging system. The electrical link is similar to the hydraulic link as described in FIG. 6. Thanks to this electrical link, communication can be established between the logging system and the coring machine. Then data can also be exchange to/from surface via the communication system for the coring machine. This link also allows electrical power to be fed from the coring machine to the logging system.

When operating the coring machine over a few short intervals, it is possible to dump higher quality coring fluid in the required location (the tool-face). As the coring machine is performing a closed pumping loop between the main well and the cored hole, there is minimum fluid mixing between the fluid originally in the well-bore and the coring fluid. This insures that the cores are extracted with minimum damage.

The intelligent coring machine can be lowered via a tubing, drill string or coil-tubing.

The coring machine can be installed at the bottom of a tubing string. For this application, some functions of the coring machine may not be required:

a) The crawling function (as described in FIG. 3) may not be required. This allows a more simple construction of the machine. The displacement in the well-bore will be obtained as with conventional well operation by moving the tubing form the surface (the tubing may be attached to the hook of the rig). WOB for coring would be obtained by applied some weight of the string onto the coring machine. The reaction torque from coring process would be supported by the spring also (as when drilling with motor). The axial pushing system (22 of FIG. 2) may however be kept in action to insure the smooth control of WOB and ROP for coring.

b) The orienting sub (as described in FIG. 8) is not required if the tubing string can be rotated from the surface (with the rig rotary table for example). When operating with a coiled tubing this orienting sub is mandatory.

c) The down-hole pump for circulation is also not required, as circulation for coring process may be generated by surface pump (for example, the triplex of the drilling rig). This circulation from surface also allows to circulate special fluid for coring for minimizing core damage.

d) The rotation of the rotary head (2 of FIG. 2) can be generated by a hydraulic motor in place of the motor (10 of FIG. 2). A PDM as used in steerable motors is the preferred solution.

e) The coring machine may communicate with the surface via MWD type telemetry. This mode of communication can be in both direction. Thanks to such a method the wireline cable 7 of FIG. 1 is not required.

With such modifications, the coring machine operated from tubing does not include high power electrical function.

The down-hole extension mechanism of the crawler may be operated to insure smooth controlled displacement during coring.

Figure 24:
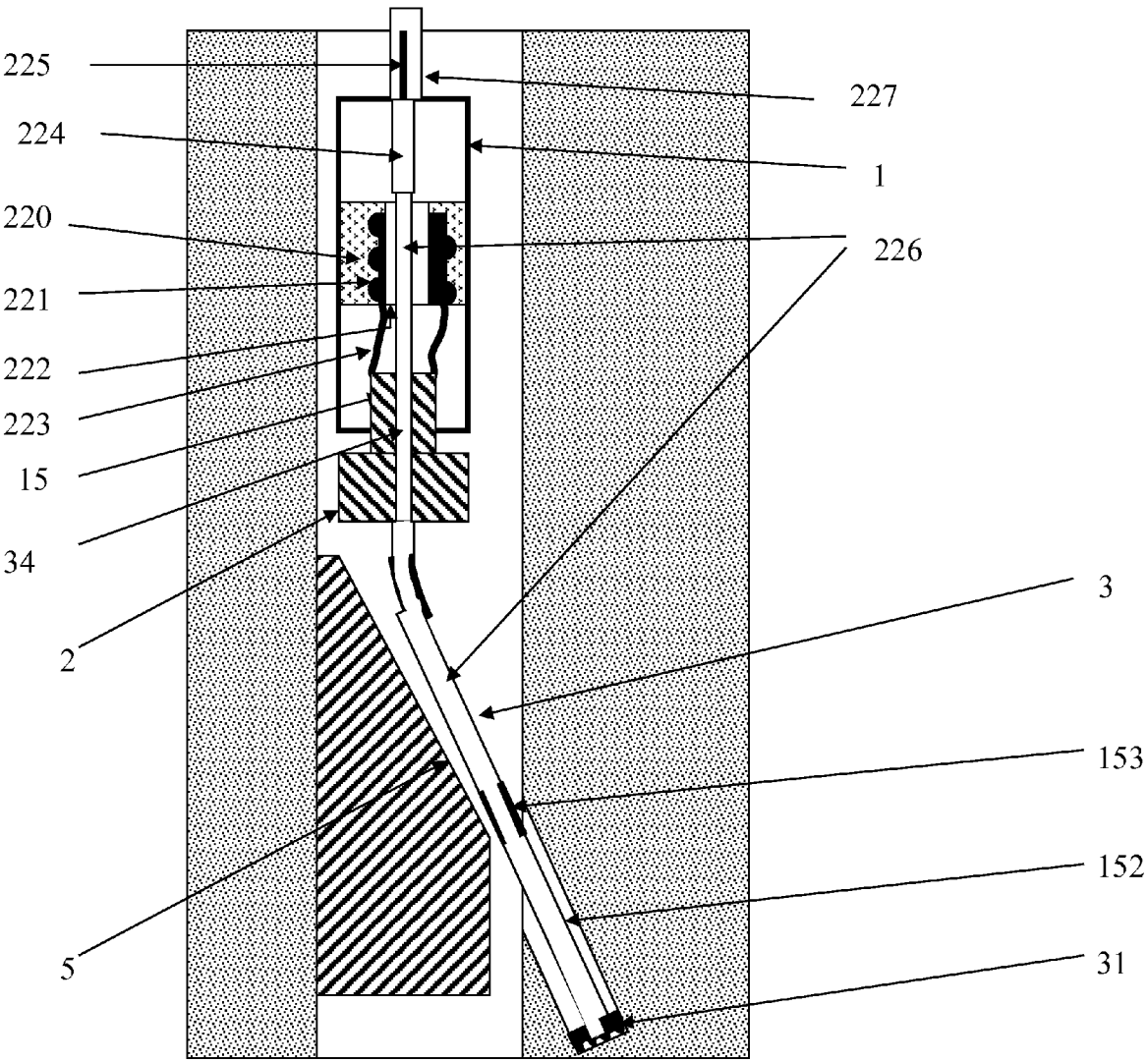
FIG. 24 shows the coring apparatus used for enabling "core fishing by slick line"
Figure 25:
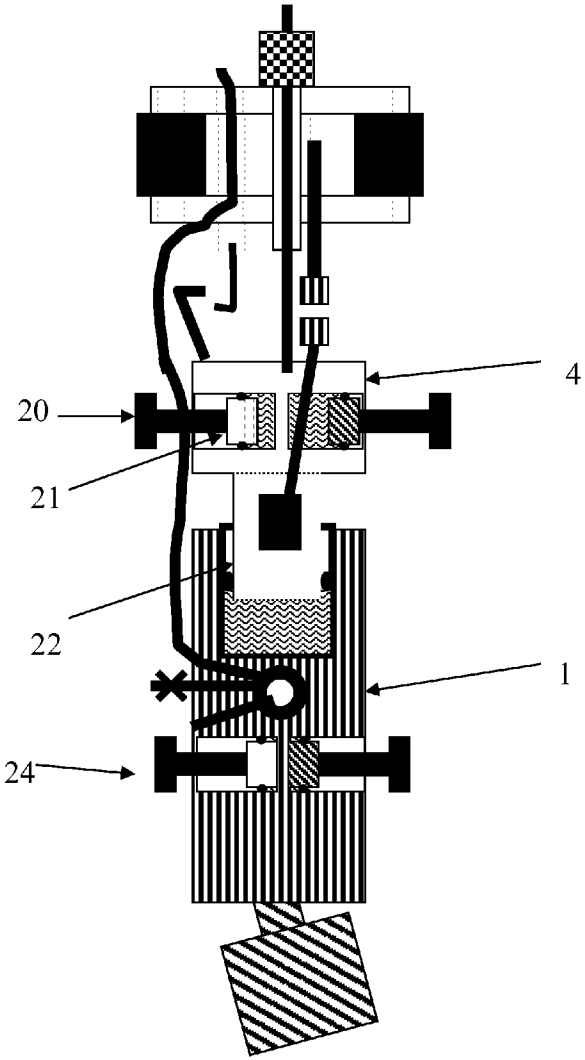
FIG. 25 shows a coring system.

A tubing controlled "full-bore" coring machine can be used for core fishing by slick line as shown in FIG. 24.

The coring tool 3 is typically limited to 2.5 inches: the required drilling power is then also limited (in the range of 10 kwatt). With the tubing operated coring machine (described above), the hydraulic motor 220 can have a diameter of 4.75" (or larger). This hydraulic motor may be based on 4/5 or 7/8 lobe configuration. The motor length would also be limited (a few meters).

With such configuration,

A large by-pass hole 222 can be bored in the rotor 221: this hole diameter can be 1.5" or more. The rotor orbit can be kept small by keeping the spiral cavity shallow.

A special elastic tube is used a hollow transmission shaft 223 between the motor rotor and the rotary head shaft 15. This tube can also have a large bore (1.5 inches or more).

A full-bore valve allows the motor rotor by-pass to be opened or closed.

The tube 34 (FIG. 4) supporting the internal static tube 33 of the coring tool 3 can be extended by a tube across the transmission and the motor rotor.

With such a transmission, a full bore 226 is present from the top of the motor to the rotary head.

The coring tool can be based on the system described in FIG. 17 with rigid section 152 and flexible section 153. However it is modified so the internal diameter of the internal tube equals the internal diameter of the shaft 34.

With such a coring machine 1 equipped with such a coring tool 3, the core can pass through the rotary head and the motor. With proper annular construction of the whole machine, the core can reach the top of the machine. It can be pushed into fishable static tube 33. When filled, the tube with the core can be fished by slick-line 225 through the tubing 227.

For time saving, a temporary core storage tube is also present in the machine. When this tube is filled, a valve system allow to divert fluid so that the core is pushed upwards in the fishable static tube: the temporary core storage tube is then empty. The slick-line can then bring the core to surface, then a new empty fishable tube is lowered. During this trip in and out, the coring can be restarted.

The invention claimed is:

1. A system for coring an underground formation surrounding a borehole, comprising:

a tool body that can be positioned in the borehole near the formation to be cored, the tool body including a motor;

a rotary drive head connected to the motor, wherein the rotary drive head has a female connector to which the coring tool connects, and a hollow shaft extending away from the rotary drive head into the tool body, and wherein the motor connects to the outer surface of the hollow shaft to drive the rotary drive head;

a rotary tool connected to the rotary drive head and one end and carrying a drill bit at the other end, wherein the rotary tool is a tubular coring tool conveying an annular drill bit;

a drive mechanism including an operable anchor for anchoring in the borehole and an axial drive for advancing tool body and the rotary tool; and a guide for urging the rotary tool laterally from the borehole into the surrounding formation.

2. A system as claimed in claim 1, wherein the rotary drive head is operable to allow the axis of the coring tool to deviate from the axis of the tool body.

3. A system as claimed in claim 2, wherein the rotary drive head includes an adjustable connection to allow the deviation of the coring tool axis to be varied.

4. A system as claimed in claim 2, wherein the tool includes means to direct the deviated axis in a predetermined direction.

5. A system as claimed in claim 1, further comprising an angular position sensor for detecting the angular position of the hollow shaft.

6. A system as claimed in claim 5, wherein the angular position sensor derives the rotary speed of the hollow shaft.

7. A system as claimed in claim 1, wherein the anchor comprises at least one set of radially-extending pads which engage the borehole wall when activated to anchor the tool body in the borehole.

8. A system as claimed in claim 7, wherein the axial drive operates to act against the anchoring force provided by the pads when activated.

9. A system as claimed in claim 8, wherein the drive mechanism comprises a hydraulic system, the pads and the axial drive comprising pistons in cylinders to which hydraulic fluid is provided.

10. A system as claimed in claim 7, wherein the drive system comprises at least two sets of pads which can be alternately activated to allow the tool body to move in either direction along the borehole.

11. A system as claimed in claim 1, wherein the coring tool comprises an outer rotary tube carrying the annular drill bit, and connected to the rotary drive head; and an inner core barrel for supporting a core drilled from the formation by the coring tool.

12. A system as claimed in claim 11, wherein the inner core barrel does not rotate with the outer rotary tube.

13. A system as claimed in claim 11, wherein the inner core barrel is connected to a shaft which extends through the rotary drive head.

14. A system as claimed in claim 13, further comprising an orientation reference collar surrounding the shaft, the collar and shaft being provided with inter-engaging formations to prevent relative rotation.

15. A system as claimed in claim 14, wherein the inter-engaging formations comprise a key and groove which allow the collar to slide relative to the shaft.

16. A system as claimed in claim 14, wherein the collar is moveable between a first position in which it is held against rotation relative to the tool body, and a second position in which it is held against rotation relative to the outer rotary tube; such that in the first position, the collar and shaft can rotate with the tool body relative to the outer rotary tube, and in the second position can rotate with the outer rotary tube relative to the tool body.

17. A system as claimed in claim 16, further comprising an electromagnet that is operable to move the collar between the first and second positions.

18. A system as claimed in claim 16, wherein the collar has an inclined surface, and a corresponding inclined contact surface is provided on the tool body; such that when the collar is in the first position the effect of contact between the inclined surfaces is to orient the shaft to a predetermined angular position relative to the tool body.

19. A system for coring an underground formation surrounding a borehole, comprising:

a tool body that can be positioned in the borehole near the formation to be cored, the tool body including a motor;

a rotary drive head connected to the motor;

a rotary tool connected to the rotary drive head and one end and carrying a drill bit at the other end, wherein the rotary tool is a tubular coring tool conveying an annular drill bit;

a drive mechanism including an operable anchor for anchoring in the borehole and an axial drive for advancing tool body and the rotary tool;

a guide for urging the rotary tool laterally from the borehole into the surrounding formation;

an outer rotary tube carrying the annular drill bit, and connected to the rotary drive head;

an inner core barrel for supporting a core drilled from the formation by the coring tool, wherein the inner core barrel is connected to a shaft which extends through the rotary drive head; and an orientation reference collar surrounding the shaft, the collar and shaft being provided with inter-engaging formations to prevent relative rotation.

20. A system as claimed in claim 19, wherein the collar is moveable between a first position in which it is held against rotation relative to the tool body, and a second position in which it is held against rotation relative to the outer rotary tube; such that in the first position, the collar and shaft can rotate with the tool body relative to the outer rotary tube, and in the second position can rotate with the outer rotary tube relative to the tool body.

* * * * *